US009002255B2

(12) United States Patent
Kanamoto

(10) Patent No.: US 9,002,255 B2
(45) Date of Patent: Apr. 7, 2015

(54) PRINTING APPARATUS AND PRINTING APPARATUS CONTROL METHOD

(75) Inventor: Yoshiji Kanamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 245 days.

(21) Appl. No.: 13/343,048

(22) Filed: Jan. 4, 2012

(65) Prior Publication Data

US 2012/0183340 A1 Jul. 19, 2012

(30) Foreign Application Priority Data

Jan. 17, 2011 (JP) ..... 2011-007314

(51) Int. Cl.

| | |
|---|---|
| ***G03G 15/00*** | (2006.01) |
| ***B41J 29/38*** | (2006.01) |
| ***B41J 11/48*** | (2006.01) |
| ***B41J 3/46*** | (2006.01) |

(52) U.S. Cl.
CPC . *B41J 11/485* (2013.01); *B41J 3/46* (2013.01)

(58) Field of Classification Search
CPC ..... G03B 15/00; B41J 29/38
USPC ..... 399/382; 400/76
See application file for complete search history.

(56) References Cited

U.S. PATENT DOCUMENTS

| | | | | |
|---|---|---|---|---|
| 6,751,426 | B2 * | 6/2004 | Akiba et al. | 399/82 |
| 2003/0113130 | A1 * | 6/2003 | Robertson et al. | 399/82 |
| 2005/0213139 | A1 * | 9/2005 | Mach et al. | 358/1.15 |
| 2005/0276641 | A1 * | 12/2005 | Morita | 399/382 |
| 2009/0141297 | A1 * | 6/2009 | Aizono et al. | 358/1.9 |

FOREIGN PATENT DOCUMENTS

| | | | | | |
|---|---|---|---|---|---|
| JP | 03067824 | A | * | 3/1991 | B41J 29/48 |
| JP | 11032139 | A | * | 2/1999 | B04N 1/00 |
| JP | 2000185445 | A | * | 7/2000 | B41J 29/38 |
| JP | 2001058445 | A | * | 3/2001 | B41J 29/38 |
| JP | 2001-199140 | A | | 7/2001 | |
| JP | 2003-246129 | A | | 9/2003 | |
| JP | 2006082509 | A | * | 3/2006 | B41J 29/38 |
| JP | 2006155013 | A | * | 6/2006 | B41J 29/38 |
| JP | 2006-239931 | A | | 9/2006 | |
| JP | 2006239931 | A | * | 9/2006 | B41J 29/38 |
| JP | 2007136798 | A | * | 6/2007 | G02G 21/00 |
| JP | 2008168599 | A | * | 7/2008 | B41J 29/38 |
| JP | 2009-123123 | A | | 6/2009 | |
| JP | 2010076282 | A | * | 4/2010 | B41J 29/38 |
| JP | 2011-008044 | A | | 1/2011 | |

OTHER PUBLICATIONS

Japanese Office Action issued in corresponding application No. 2011-007314 on Sep. 22, 2014.

* cited by examiner

*Primary Examiner* — Nguyen Ha
(74) *Attorney, Agent, or Firm* — Carter, DeLuca, Farrell & Schmidt, LLP

(57) ABSTRACT

A printing apparatus of this invention includes a printing unit that executes print processing for a sheet, and feeding units that respectively store sheets conveyable to the printing unit. The printing apparatus identifies a sheet to undergo print processing, based on obtained print job data, and searches the feeding units for a feeding unit storing the identified sheet. The printing apparatus, when it detects the feeding unit storing the identified sheet, controls the printing unit to execute print processing based on the print job data for the sheet fed from the feeding unit, and when it cannot detect the feeding unit storing the identified sheet, executes avoiding processing regarding the print processing.

9 Claims, 27 Drawing Sheets

FIG. 4

703

| 701 ID | 702 Name | 710 Left | 711 Right | 712 Deck1 | 713 Deck2 | SETTABLE SHEET FEEDING CASSETTE | 714 Insert1 | 715 Insert2 | 716 Insert3 |
|---|---|---|---|---|---|---|---|---|---|
| 704 ..... | | ..... | ..... | ..... | ..... | ..... | ..... | ..... | ..... |
| 705 1 | Plain | T | T | T | T | ..... | T | T | T |
| 706 2 | Heavy | T | T | T | T | ..... | T | T | T |
| 707 3 | Super Heavy | T | T | F | F | ..... | T | T | T |
| ..... | ..... | ..... | ..... | ..... | ..... | ..... | ..... | ..... | ..... |
| 708 5 | Single Coated | F | F | F | F | ..... | T | T | T |
| 709 6 | Double Coated | F | F | F | F | ..... | T | T | T |
| ..... | ..... | ..... | ..... | ..... | ..... | ..... | ..... | ..... | ..... |

FIG. 8

```
<?xml version="1.0" encoding="UTF-8"?>
<JDF ID="ID01" JobPartID="JobPartID01" Type="Combined" Activation="Active"
Status="Ready"
Types="LayoutPreparation Imposition Interpreting Rendering DigitalPrinting Stitching
HoleMaking"
Version="1.2" Category="DigitalPrinting" MaxVersion="1.2" xmlns="http://
www.CIP4.org/JDFSchema_1_1"
JobID="JobID01" DescriptiveName="Sample 01">

</AuditPool>

<ResourcePool>
   <RunList Class="Parameter" ID="IDRL" Status="Available" PartIDKeys="Run"/>
   <LayoutPreparationParams Class="Parameter" ID="IDLPP" Status="Available"
Sides="OneSidedFront"/>
   <InterpretingParams Class="Parameter" ID="IDIP" Status="Available"/>
   <RenderingParams Class="Parameter" ID="IDRP" Status="Available" />
   <ColorantControl Class="Parameter" ID="IDCC" Status="Available"/>

   <DigitalPrintingParams Class="Parameter" ID="IDDPP" Status="Available"
Collate="SheetSetAndJob"
      PartIDKeys="RunIndex">
      <MediaRef rRef="MED_000"/>          1101

      <DigitalPrintingParams RunIndex="0">
         <MediaRef rRef="MED_001"/>       1102
      </DigitalPrintingParams>

      <DigitalPrintingParams RunIndex="-1">
         <MediaRef rRef="MED_000"/>       1103
      </DigitalPrintingParams>

   </DigitalPrintingParams>
```

FIG. 9

```
<Component Class="Quantity" ID="IDC" ComponentType="PartialProduct"
Status="Unavailable"/>
<Component Class="Quantity" ID="IDC_ST" ComponentType="PartialProduct"
Status="Unavailable"/>
<Component Class="Quantity" ID="IDC_FP" ComponentType="FinalProduct"
Status="Unavailable"/>
                    1104
<Media ID="MED_000" Class="Consumable" Status="Available" Dimension="595
842"
    MediaType="Plain"/>          1105
<Media ID="MED_001" Class="Consumable" Status="Available" Dimension="595
842"
    MediaType="Single Coated"/>

<StitchingParams ID="IDST" Class="Parameter" Status="Available" NoOp="true"
StitchType="Corner"/>
<HoleMakingParams ID="IDFP" Class="Parameter" Status="Available"
NoOp="true"/>
</ResourcePool>

<ResourceLinkPool>
<LayoutPreparationParamsLink rRef="IDLPP" Usage="Input"
CombinedProcessIndex="0"/>
<RunListLink rRef="IDRL" Usage="Input" CombinedProcessIndex="0 1"/
>
<ComponentLink rRef="IDC_ST" Usage="Output" CombinedProcessIndex="5"/>
<ComponentLink rRef="IDC_ST" Usage="Input" CombinedProcessIndex="6"/>
<FoldingParamsLink rRef="IDFP" Usage="Input" CombinedProcessIndex="6"/>
<ComponentLink rRef="IDC_FP" Usage="Output" CombinedProcessIndex="6"/>
</ResourceLinkPool>
</JDF>
```

FIG. 13

```
<?xml version="1.0" encoding="UTF-8"?>
<JDF ID="ID01" JobPartID="JobPartID01" Type="Combined" Activation="Active"
Status="Ready"
Types="LayoutPreparation Imposition Interpreting Rendering DigitalPrinting Stitching
HoleMaking"
Version="1.2" Category="DigitalPrinting" MaxVersion="1.2" xmlns="http://
www.CIP4.org/JDFSchema_1_1"
JobID="JobID01" DescriptiveName="Sample 01">

</AuditPool>

<ResourcePool>  1501
  <RunList Class="Parameter" ID="IDRL" Status="Available" PartIDKeys="Run"/>

  <LayoutPreparationParams Class="Parameter" ID="IDLPP" Status="Available"
Sides="OneSidedFront"
    PartIDKeys="RunIndex">
    <LayoutPreparationParams RunIndex"0">
      <InsertSheet SheetUsage="Header" SheetFormat="Blank"
SheetType="InsertSheet">
        <Sheet><MediaRef rRef="MED_001"/></sheet>
      </InsertSheet>  1502
    </LayoutPreparationParams
  </LayoutPreparationParams>

  <InterpretingParams Class="Parameter" ID="IDIP" Status="Available"/>
  <RenderingParams Class="Parameter" ID="IDRP" Status="Available" />
  <ColorantControl Class="Parameter" ID="IDCC" Status="Available"/>

  <DigitalPrintingParams Class="Parameter" ID="IDDPP" Status="Available"
Collate="SheetSetAndJob"
    PartIDKeys="RunIndex">
    <MediaRef rRef="MED_000"/>
  </DigitalPrintingParams>
```

FIG. 14

```
<Component Class="Quantity" ID="IDC" ComponentType="PartialProduct"
Status="Unavailable"/>
<Component Class="Quantity" ID="IDC_ST" ComponentType="PartialProduct"
Status="Unavailable"/>
<Component Class="Quantity" ID="IDC_FP" ComponentType="FinalProduct"
Status="Unavailable"/>
                                    1503
<Media ID="MED_000" Class="Consumable" Status="Available" Dimension="595
842"
    MediaType="Plain"/>                    1504
<Media ID="MED_001" Class="Consumable" Status="Available" Dimension="595
842"
    MediaType="Single Coated"/>

<StitchingParams ID="IDST" Class="Parameter" Status="Available" NoOp="true"
StitchType="Corner"/>
<HoleMakingParams ID="IDFP" Class="Parameter" Status="Available"
NoOp="true"/>
</ResourcePool>

<ResourceLinkPool>
<LayoutPreparationParamsLink rRef="IDLPP" Usage="Input"
CombinedProcessIndex="0"/>
<RunListLink rRef="IDRL" Usage="Input" CombinedProcessIndex="0 1"/
>
<ComponentLink rRef="IDC_ST" Usage="Output" CombinedProcessIndex="5"/>
<ComponentLink rRef="IDC_ST" Usage="Input" CombinedProcessIndex="6"/>
<FoldingParamsLink rRef="IDFP" Usage="Input" CombinedProcessIndex="6"/>
<ComponentLink rRef="IDC_FP" Usage="Output" CombinedProcessIndex="6"/>
</ResourceLinkPool>
</JDF>
```

FIG. 18

| | 1901 ID | 1902 NAME | 1903 GRAMMAGE | 1904 SURFACE PROPERTY | 1905 COLOR | 1906 PREPRINTING | 1907 PREPRINTED SHEETPRINTING ENABLE/DISABLE | |
|---|---|---|---|---|---|---|---|---|
| 1908 | 1 | Media-1 | 52 g/m$^2$ | WOODFREE PAPER | WHITE | No | N/A | ... |
| 1909 | 2 | Media-2 | 52 g/m$^2$ | WOODFREE PAPER | WHITE | No | N/A | ... |
| 1910 | 3 | Media-3 | 52 g/m$^2$ | WOODFREE PAPER | WHITE | No | N/A | ... |
| 1911 | 4 | Media-4 | 90 g/m$^2$ | THICK PAPER | WHITE | No | N/A | ... |
| | ⋮ | ⋮ | ⋮ | ⋮ | ⋮ | ⋮ | ⋮ | ⋱ |

FIG. 23

| | 1901 ID | 1902 NAME | 1903 GRAMMAGE | 1904 SURFACE PROPERTY | 1905 COLOR | 1906 PREPRINTING | 1907 PREPRINTED SHEETPRINTING ENABLE/DISABLE | |
|---|---|---|---|---|---|---|---|---|
| 1908 | 1 | Media-1 | 52 g/m$^2$ | WOODFREE PAPER | WHITE | Yes | Disable | ··· |
| 1909 | 2 | Media-2 | 52 g/m$^2$ | WOODFREE PAPER | WHITE | Yes | Enable | ··· |
| 1910 | 3 | Media-3 | 52 g/m$^2$ | WOODFREE PAPER | WHITE | No | N/A | ··· |
| 1911 | 4 | Media-4 | 90 g/m$^2$ | THICK PAPER | WHITE | No | N/A | ··· |
| | ⋮ | ⋮ | ⋮ | ⋮ | ⋮ | ⋮ | ⋮ | ⋱ |

PRINTING APPARATUS AND PRINTING APPARATUS CONTROL METHOD

BACKGROUND OF THE INVENTION

1. Field of the Invention

The present invention relates to a printing apparatus and printing apparatus control method.

2. Description of the Related Art

A printing apparatus which forms a printed material using a plurality of types of media (sheets) has conventionally been known. When such a printing apparatus forms a printed material using a plurality of types of media, media contained in the printed material are not limited to those having undergone print processing by the printing apparatus. In some cases, a preprinted sheet having undergone print processing in advance by another printing apparatus is stored in a feeding unit and inserted into media to undergo print processing in formation of a printed material. Hence, for example, even a printing apparatus capable of only monochrome printing can form a printed material containing a color page by inserting a preprinted sheet bearing a color image.

Note that preprinted sheets as media to be inserted are assumed to be stored at a plurality of locations. The first storage location can be a sheet feeding cassette which holds media to undergo print processing in order to supply them to the printing apparatus (to be simply referred to as a sheet feeding cassette). When post-processing units configured to perform various post-processes for media discharged from the printing apparatus include an insertion unit called an inserter, the insertion unit can be used as the second storage location.

Techniques regarding the above technique are disclosed in, for example, Japanese Patent Laid-Open Nos. 2001-199140, 2006-239931, and 2009-123123.

As described above, there is a printing apparatus including two types of feeding units, that is, a feeding unit (first feeding unit) for feeding media to the printer main body which performs print processing, and an inserter (second feeding unit) arranged on the succeeding stage of the printer main body.

However, the conventional technique unitarily manages media suited to be set in the first feeding unit and those suited to be set in the second feeding unit, without discriminating them. For this reason, the operator may designate the type of medium to be printed without taking account of which of the first and second feeding units is suitable for setting each medium.

SUMMARY OF THE INVENTION

The present invention has been made to solve the above problems, and provides a mechanism capable of preventing an error generated when a feeding unit which stores printing media of a type identified by print settings contained in print job data is not detected.

According to one aspect of the present invention, there is provided a printing apparatus comprising: a printing unit that executes print processing for a sheet; first feeding units that store sheets conveyable to the printing unit; an obtaining unit that obtains print job data; an analysis unit that identifies a sheet to undergo print processing, based on the print job data; a search unit that searches the first feeding units for a feeding unit storing the sheet identified by the analysis unit; and a control unit that, when the search unit detects the feeding unit storing the sheet identified by the analysis unit, controls the printing unit to execute print processing based on the print job data for the sheet fed from the feeding unit, wherein when the search unit cannot detect the feeding unit storing the sheet identified by the analysis unit, the control unit executes avoiding processing regarding the print processing.

According to another aspect of the present invention, there is provided a method for controlling a printing apparatus including a printing unit that executes print processing for a sheet, and feeding units that store sheets conveyable to the printing unit, comprising: obtaining print job data; identifying a sheet to undergo print processing, based on the print job data; searching the feeding units of the printing apparatus for a feeding unit storing the sheet identified in the identifying a sheet; and when the feeding unit storing the sheet identified in the identifying a sheet is detected in the searching the feeding units, controlling the printing unit to execute print processing based on the print job data for the sheet fed from the feeding unit, wherein in the controlling the printing unit, when the feeding unit storing the sheet identified in the identifying a sheet cannot be detected in the searching the feeding units, avoiding processing regarding the print processing is executed.

The present invention can provide a mechanism capable of preventing an error generated when a feeding unit which stores printing media of a type identified by print settings contained in print job data is not detected.

Further features of the present invention will become apparent from the following description of exemplary embodiments (with reference to the attached drawings).

BRIEF DESCRIPTION OF THE DRAWINGS

FIG. 4 is a table showing details of medium management information stored in an HDD 209;

FIG. 8 is a view exemplifying print setting information (former part) generated by the print application;

FIG. 9 is a view exemplifying print setting information (latter part) generated by the print application;

FIG. 13 is a view exemplifying print setting information (former part) generated by the print application;

FIG. 14 is a view exemplifying print setting information (latter part) generated by the print application;

FIG. 18 is a table showing details of medium management information stored in an HDD 209;

FIG. 23 is a table showing details of medium management information stored in the HDD 209;

DESCRIPTION OF THE EMBODIMENTS

First Embodiment

Figure 1:
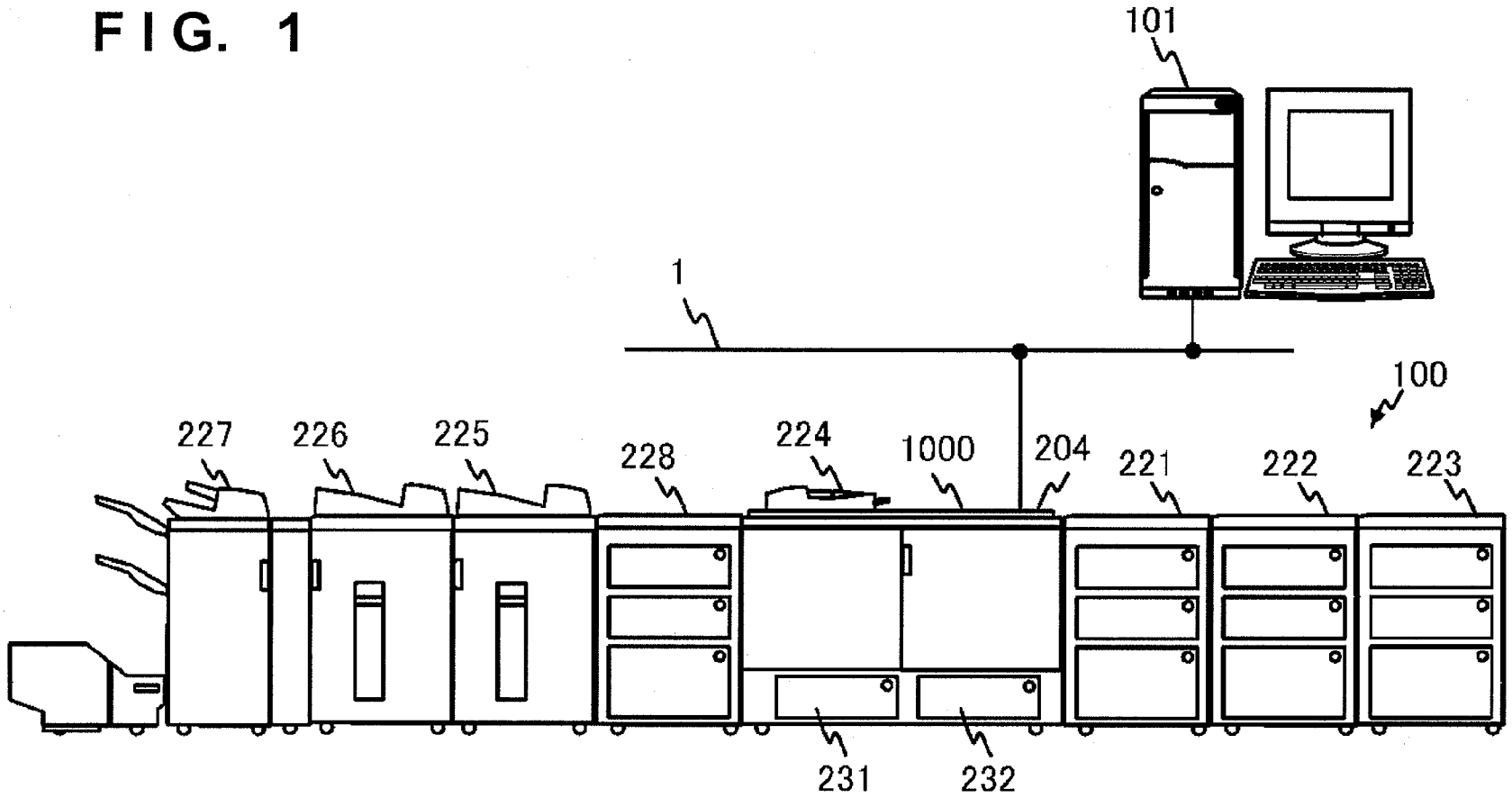
FIG. 1 is a view showing the overall configuration of a printing system according to the first embodiment of the present invention.

System Configuration (FIG. 1)

FIG. 1 is a view showing the overall configuration of a printing system according to the first embodiment of the present invention. The printing system includes a digital printer 100 and computer 101 which can communicate with each other via a network 1. The computer 101 is a general-purpose computer connected to a printer main body 1000 via the network 1. The computer 101 can execute various application programs, and transmit a print job to the digital printer 100.

The digital printer 100 is configured by coupling units having a plurality of different functions to be detachable from each other so that the digital printer 100 can perform complicated sheet processing. The digital printer 100 includes the printer main body 1000, large-volume feeding units 221, 222, and 223, an inserter 228, large-volume stackers 225 and 226, and a saddle stitching unit 227.

The printer main body 1000 is a unit for printing on a medium using toner in accordance with rasterized image data. The general arrangement and operation principle of the printer main body 1000 are as follows. A rotating polyhedral mirror (for example, polygon mirror) deflects a beam (for example, laser beam) modulated in accordance with image data. The deflected beam is reflected by a reflecting mirror and irradiates a photosensitive drum as scanning light. A latent image formed by the laser beam on the photosensitive drum is developed using toner, and the toner image is transferred onto a sheet material (medium) supported on a transfer drum. The series of print processes is executed sequentially for yellow (Y), magenta (M), cyan (C), and black (K) toners, forming a full-color image. It may be configured to transfer a so-called spot color toner, transparent toner, and the like in addition to toners of these four colors. The sheet material which bears the full-color image on its surface and is supported on the transfer drum is conveyed to a fixing unit. The fixing unit is formed from a combination of rollers and a belt, and incorporates a heat source such as a halogen heater. The fixing unit fuses and fixes toner on the conveyed sheet material by heat and pressure.

The large-volume feeding units 221, 222, and 223 are units which store large volumes of media to be fed into the printer main body 1000. The large volume feeding units 221, 222, and 223 supply media stored in them to the printer main body 1000 successively at appropriate timings. The large-volume feeding units 221, 222, and 223 can detect the remaining amounts of media stored in them.

The large-volume stackers 225 and 226 are units for internally stocking printed media output in volume. The digital printer 100 includes the large-volume feeding units, the volume of generated output materials inevitably becomes large, and thus the large-volume stackers 225 and 226 are needed.

The inserter 228 is a unit having a function of inserting, at proper timings based on settings, media held in the inserter 228 between media successively supplied from the printer main body 1000. The inserter 228 can insert, between printed media, media requiring no printing. The inserter 228 includes a plurality of large-volume sheet feeding cassettes so that it can stand large-volume print processing, similar to the large-volume feeding units 221, 222, and 223.

The saddle stitching unit 227 includes various units capable of selectively executing stapling, cutting, punching, folding, shift discharge, and the like for media sent from the printer main body 1000.

Note that even the printer main body 1000 incorporates sheet feeding cassettes 231 and 232, and can execute the same function as that of the large-volume feeding units 221 to 223. The sheet feeding cassettes 231 and 232 and the large-volume feeding units 221 to 223 function as the first feeding units. However, in the following description, the large-volume feeding units 221 to 223 include even the sheet feeding cassettes 231 and 232 of a printer unit 203 for convenience.

Devices (that is, the inserter 228, large-volume stackers 225 and 226, and saddle stitching unit 227) arranged on the left side of the printer main body 1000 in FIG. 1 are called sheet processing units. The inserter 228 functions as the second feeding unit. For example, the sheet processing units perform various processes for media having undergone print processing, and accumulate the media. The large-volume feeding units 221 to 223 and sheet processing units will be called sheet processing units 200.

<Internal Arrangement of Digital Printer 100 (FIG. 2)>

The internal arrangement of the digital printer 100 will be explained with reference to FIG. 2. The digital printer 100 is an MFP type printing apparatus (to be also referred to as an image forming apparatus) having a plurality of functions. The functions of the digital printer 100 are, for example, a copy function and print function. With the copy function, the printer unit 203 prints, via a hard disk drive (HDD) 209, job data accepted from a scanner unit 201 of the printer main body 1000. With the print function, the printer unit 203 prints, via the HDD 209, job data accepted from the computer 101 via an external interface (I/F) 202. Note that the digital printer 100 can be a printing apparatus capable of color printing or printing apparatus capable of monochrome printing. The arrangement is arbitrary as long as the digital printer 100 can execute various control operations to be described later.

The digital printer 100 includes the scanner unit 201, the external I/F 202, the HDD 209, the printer unit 203, an operation unit 204, a control unit 205, a ROM 207, a RAM 208, a compression/decompression unit 210, and a medium management unit 211. The printer unit 203, scanner unit 201, and operation unit 204 are arranged in the printer main body 1000.

The scanner unit 201 is a unit which scans a document image and performs image processing for the scanned image data. The external I/F 202 is a unit which transmits/receives image data and the like to/from a facsimile apparatus, network connection device, and external dedicated apparatus. The HDD 209 is a unit which stores image data of a plurality of jobs to be printed that are accepted from either the scanner unit 201 or the external I/F 202. The printer unit 203 is a unit which executes print processing on a printing medium in accordance with job data to be printed that is stored in the HDD 209.

The operation unit 204 is arranged on the upper surface of the printer main body 1000. The operation unit 204 is a unit having a display panel corresponding to an example of a user interface. The operation unit 204 provides various interfaces when the operator performs various settings, operations, and the like for the printer unit 203.

The control unit 205 (for example, CPU) is a unit which comprehensively controls the processes, operations, and the like of various units in the digital printer 100. The ROM (Read Only Memory) 207 is a unit which stores various programs in advance. These programs include a boot sequence program, font information, programs for executing various processes in accordance with flowcharts to be described later, and display control programs for displaying various user interface (UI) screens on the display panel of the operation unit 204.

The control unit 205 reads out and executes programs stored in the ROM 207 to cause the digital printer 100 to execute various operations to be described later. The ROM 207 stores even a program for executing an operation of interpreting page description language (PDL) code data received (obtained) from the computer 101 via the external I/F 202 and rasterizing it into raster image data (bitmap image data). Similarly, the ROM 207 stores even a program for interpreting and processing a print job received from an external apparatus (not shown) via the external I/F 202. These programs are processed by software.

The RAM 208 is a readable & writable memory, and is a unit for storing image data, various programs, and setting information sent from the scanner unit 201 and external I/F 202 via a memory controller. The HDD 209 is a unit having a large-capacity storage area which stores image data compressed by the compression/decompression unit 210. The HDD 209 can hold data such as print data of a job to be processed.

The control unit 205 allows the printer unit 203 to print, via the HDD 209, data of jobs to be processed which have been input via various input units such as the scanner unit 201 and external I/F 202. Also, the control unit 205 allows transmitting job data to an external apparatus via the external I/F 202. In this manner, the control unit 205 controls the printer unit 203 and external I/F 202 to execute various output processes for job data which is stored in the HDD 209 and is to be processed.

The compression/decompression unit 210 compresses/decompresses image data and the like stored in the RAM 208 and HDD 209 in accordance with various compression schemes such as JBIG and JPEG. With the above arrangement, the control unit 205 controls even the operations of the respective sheet processing units 200. The sheet processing units 200 correspond to a feeding unit and sheet processing unit.

The medium management unit 211 is a unit for managing information about the type of medium that can be processed by the digital printer 100 according to the embodiment. Details of information about the medium type managed by the medium management unit 211 and control using the information will be described later.

<Various Programs and the Like (FIG. 3)>

Figure 2:
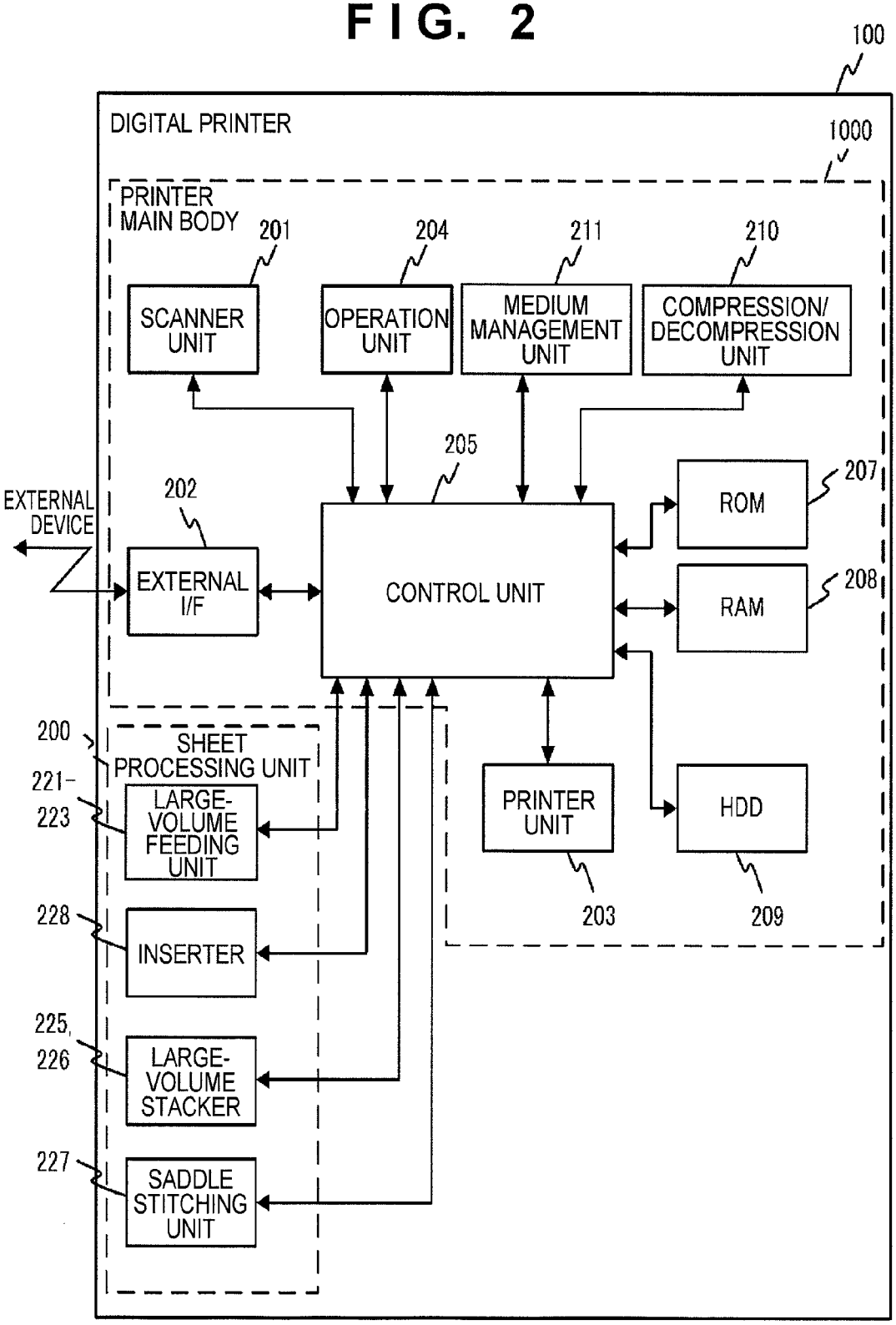
FIG. 2 is a block diagram showing the arrangement of a digital printer.
Figure 3:
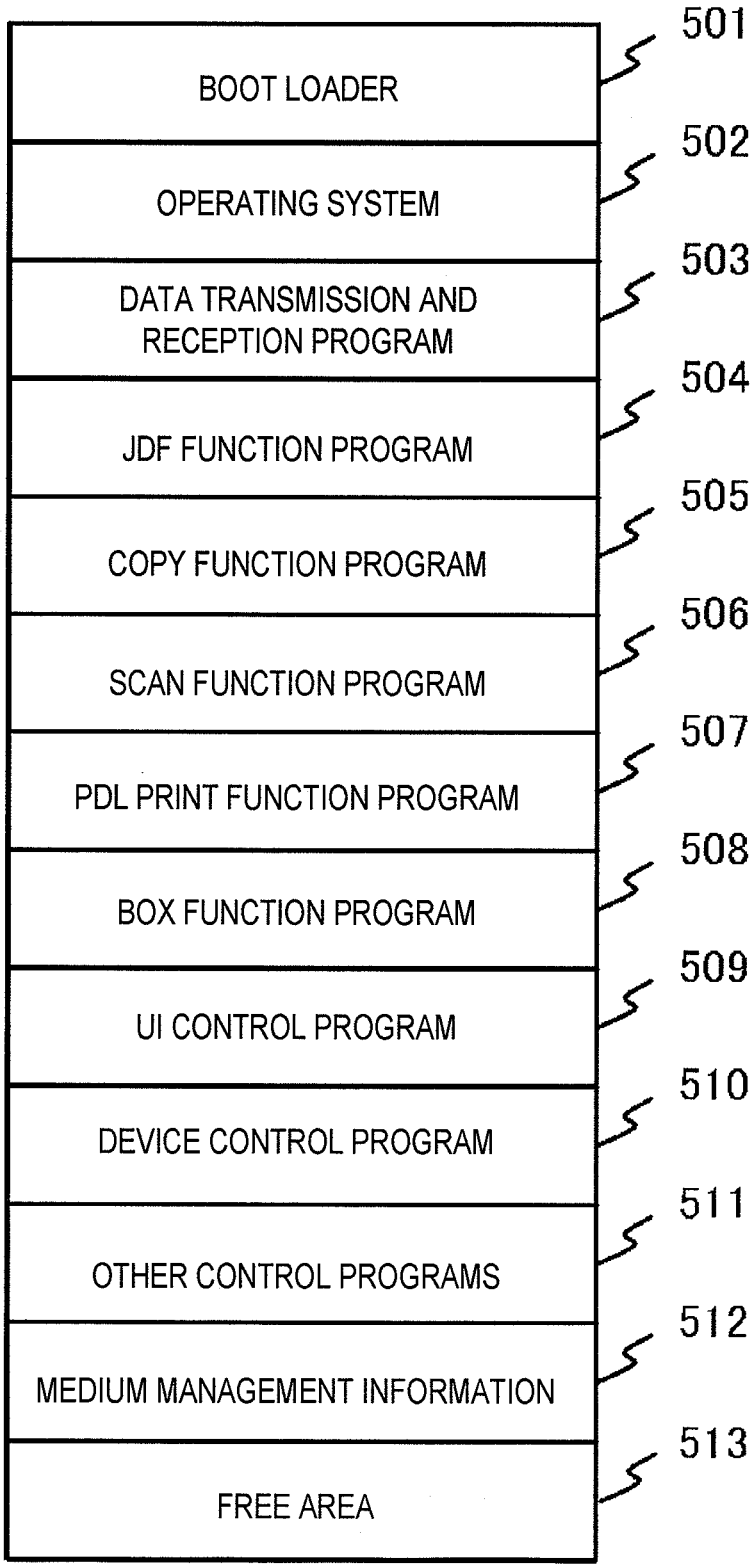
FIG. 3 is a view showing various data stored in a ROM 207.

FIG. 3 exemplifies various programs which are stored in the ROM 207 in FIG. 2, and read out and executed by the control unit 205 of the digital printer 100 according to the embodiment, and data used by the programs. As shown in FIG. 3, the ROM 207 stores control programs for implementing various functions which can be provided by the digital printer 100.

A boot loader 501 is a program which is executed immediately after turning on the digital printer 100. The boot loader 501 contains programs for executing various boot sequences necessary to boot the system of the digital printer 100.

An operating system 502 is a program which provides an execution environment for various programs for implementing the functions of the digital printer 100. The operating system 502 mainly provides functions including management of resources such as the memories (that is, the ROM 207 and RAM 208) and HDD 209 of the digital printer 100, and basic input/output control of various apparatuses shown in FIG. 2.

A data transmission and reception program 503 is a control program for transmission and reception processing performed when a data input/output request is generated via the external I/F 202. More specifically, the data transmission and reception program 503 is a control program which contains the protocol stack of TCP/IP or the like and is used to communicate with an external device or the like connected via the network 1. Processing executed by this program contains processing at the transmission and reception levels of data packets input/output between the digital printer 100 and the external I/F 202, and processing specialized in communication with an HTTP server or the like, but does not contain analysis processing regarding the contents of received data. The control unit 205 executes data analysis processing based on the description contents of another program.

A JDF (Job Definition Format) function program 504 is a program for implementing a JDF print function to be executed by the control unit 205 in accordance with an instruction from the operation unit 204 when the digital printer 100 receives JDF job data via the external I/F 202. The control unit 205 implements the JDF print function by sequentially designating the operations of respective devices in the digital printer 100 in an appropriate order based on a processing order and processing conditions described in the JDF function program 504. The respective devices include the sheet processing unit 200, printer unit 203, HDD 209, compression/decompression unit 210, and RAM 208. JDF print function is finally executed as a result of executing the JDF print function based on the JDF program 504. Also, the JDF function program 504 includes processing of analyzing JDF job data received via the external I/F 202, processing of determining, based on the result of the analysis processing, whether the JDF job data contains an invalid setting, and setting change processing of canceling the invalid setting.

A copy function program 505 is a program for implementing a copy function to be executed by the control unit 205 in accordance with an instruction from the operation unit 204 when the operator of the digital printer 100 designates execution of the copy function via the external I/F 202. The control unit 205 implements the copy function by sequentially designating the operations of respective devices in the digital printer 100 in an appropriate order based on a processing order and processing conditions described in the copy function program 505. The respective devices include the scanner unit 201, printer unit 203, sheet processing unit 200, HDD 209, compression/decompression unit 210, and RAM 208. The digital printer 100 finally executes copy processing.

A scan function program 506 is a program for implementing a scan function to be executed by the control unit 205 in accordance with an instruction from the operation unit 204 when the operator of the digital printer 100 designates execution of the scan function via the external I/F 202. The control unit 205 executes the scan function as follows. The control unit 205 controls devices such as the scanner unit 201, HDD 209, compression/decompression unit 210, and RAM 208 based on a processing order and processing conditions described in the scan function program 506. At this time, the control unit 205 sequentially designates the operations of these devices in a proper order. The digital printer 100 finally executes scan processing.

A PDL function program 507 is a program for implementing a PDL print function to be executed by the control unit 205 in accordance with an instruction from the operation unit 204 when the digital printer 100 receives PDL job data via the external I/F 202. The control unit 205 implements the PDL print function by sequentially designating the operations of respective devices in the digital printer 100 in an appropriate order based on a processing order and processing conditions described in the PDL function program 507. The respective devices include the sheet processing unit 200, printer unit 203, HDD 209, compression/decompression unit 210, and RAM 208. The digital printer 100 finally executes PDL print processing.

A BOX function program 508 is a program for implementing a BOX function to be executed by the control unit 205 in accordance with an instruction from the operation unit 204 when the operator of the digital printer 100 designates execution of the BOX function via the external I/F 202. The control unit 205 executes BOX processing by sequentially designating the operations of respective devices in the digital printer 100 in an appropriate order based on a processing order and processing conditions described in the BOX function program 508. The respective devices include the scanner unit 201, printer unit 203, sheet processing unit 200, HDD 209, compression/decompression unit 210, and RAM 208. The control unit 205 can also execute the BOX function by changing settings in storage for job data stored in the HDD 209 or the like.

A UI control program 509 is a control program for the operation unit 204. The UI control program 509 identifies contents input by the operator of the digital printer 100 via the operation unit 204, and performs a proper screen transition and a processing request to the control unit 205.

Medium management information 512 is a database storing information about media usable by the digital printer 100 that is managed by the medium management unit 211. Details of the information managed as management information will be described later. Other control programs 511 are programs for implementing functions corresponding to none of the above-described programs.

Note that the digital printer 100 need not have all the above-described programs, and may have some of them or another program.

<Medium Management Information Storage Table (FIG. 4)>

FIG. 4 exemplifies a medium management information storage table which is managed by the medium management unit 211, held in the HDD 209, and stores medium management information. The medium management information storage table is formed from a plurality of fields, and can manage, in the respective fields, information about all the types of media (sheets) usable by the digital printer 100.

An ID field 701 is a field for storing an ID assigned to each type of medium usable by the digital printer 100. In the digital printer 100, the usable medium type is unitarily managed by an ID stored in the ID field 701 of the medium management information storage table.

A name field 702 is a field for storing a name character string which is assigned to a medium type identified by an ID stored in the ID field 701 and is used to identify a medium type. A character string stored in this field is assumed to be used for screen display when the operator makes various settings regarding the medium type mainly using the operation unit 204. However, the application purpose of the character string is not limited to this.

A storable sheet feeding cassette field 703 is a field for storing information representing which of a plurality of sheet feeding cassettes of the digital printer 100 can store media of a type identified by an ID stored in the ID field 701. This field is divided into a plurality of fields for respective sheet feeding cassettes in the digital printer 100, and the respective fields store information.

The digital printer 100 according to the embodiment includes two feeding units in the printer main body 1000, three feeding units in each of three detachable feeding units connected on the preceding stage of the printer main body 1000, and three feeding units of the inserter on the succeeding stage of the printer main body 1000. That is, the digital printer 100 includes a total of 14 feeding units.

However, FIG. 4 shows only characteristic ones of the 14 feeding units which are necessary to explain the effects of the embodiment. More specifically, FIG. 4 shows, of the device arrangement of the digital printer 100, a left deck 710 and right deck 711 in the printer main body 1000, two feeding units 712 and 713 out of the detachable feeding units, and decks 714, 715, and 716 of the inserter 228.

In practice, this table lists all media managed by the medium management unit 211. However, FIG. 4 shows only some characteristic media necessary to explain the effects of the embodiment.

In the medium management information storage table of FIG. 4, a value in a field positioned at an intersection between a column corresponding to each medium and a row corresponding to each feeding unit indicates whether the medium can be stored in the feeding unit. A value "T" means that the medium can be stored in the feeding unit. A value "F" means that the medium cannot be stored in the feeding unit.

In FIG. 4, medium management information managed in the medium management information storage table is only whether each feeding unit can store a medium. In practice, however, the medium management information storage table may further contain another medium management information not shown in FIG. 4.

<Example of Transition of Print Job Setting Screen (FIGS. 5, 6, and 7)>

Figure 5:
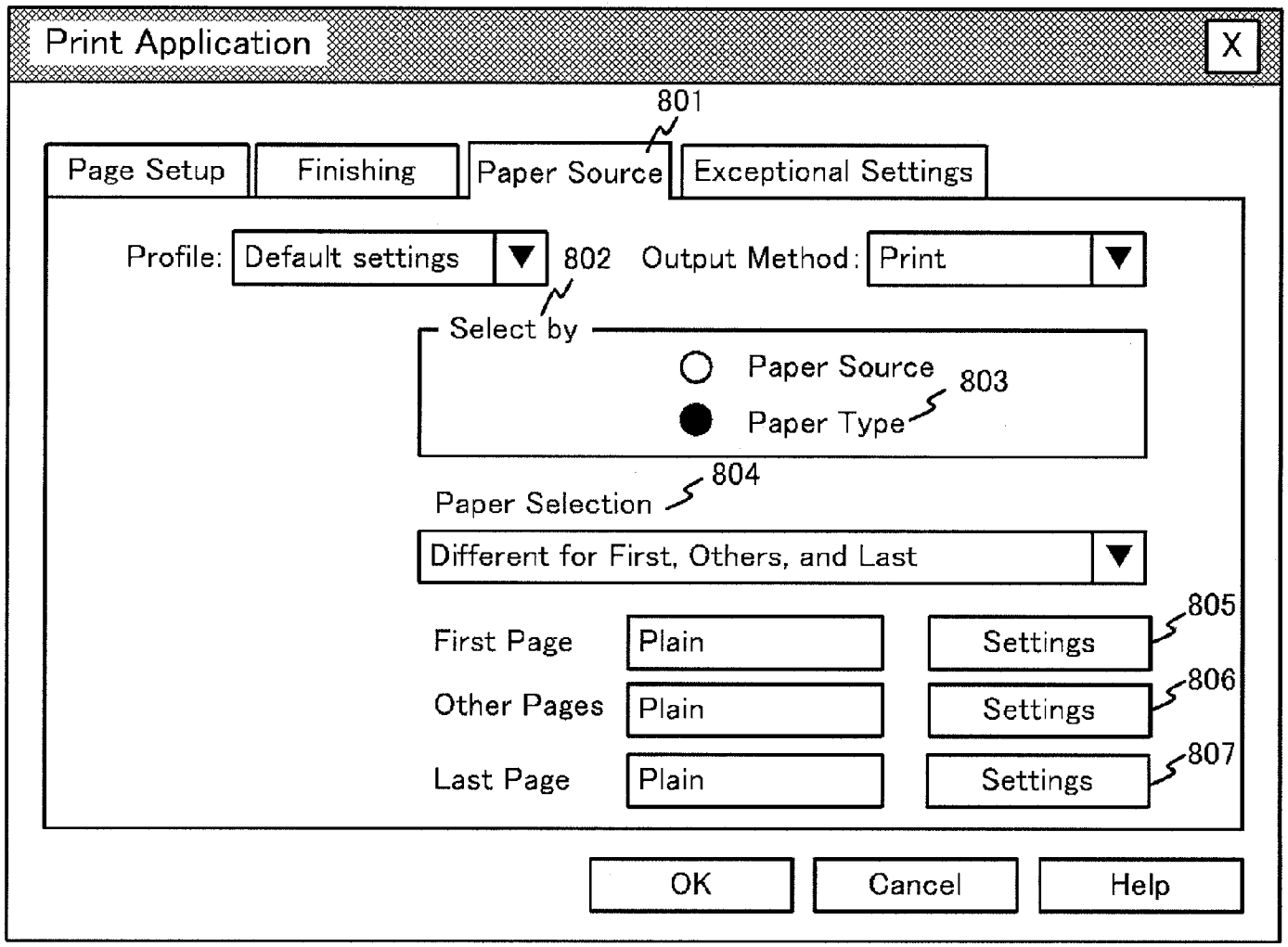
FIG. 5 is a view exemplifying the print setting screen of a print application.

FIG. 5 exemplifies a print job setting screen displayed by a print application program running on the computer 101 in FIG. 1. The print application allows various settings for a print job.

FIG. 5 exemplifies a setting screen for making settings regarding a medium used for a print job out of print job setting functions provided by the print application program. On this setting screen, a plurality of function selection tabs are arranged in correspondence with a plurality of print job setting function setting screens. These function setting tabs are a Page Setup tab, a Finishing tab, a Paper Source tab 801, and an Exceptional Settings tab. FIG. 5 shows a screen displayed upon selecting the Paper Source tab 801 for making sheet settings, out of the four function setting tabs.

Of sheet setting functions shown in FIG. 5, a Select by pane 802 allows the operator to select which of the paper source ("Paper Source") and medium type ("Paper Type") is used to designate media used in execution of a print job. In the example shown in FIG. 5, a Paper Type 803 is selected. That is, media used in execution of a print job are designated by the medium type.

A Paper Selection 804 is a function selected when making different sheet settings for a specific page, or respective pages forming the body out of pages forming a print job. In the example shown in FIG. 5, "Different for First, Others, and Last" is selected. That is, different sheet settings can be made for the first, body, and last pages of an output material (printed material).

FIG. 5 shows a state in which media of a type "Plain" (plain paper) are selected for all the first, body, and last pages of an output material. By pressing Settings buttons 805, 806, and 807 to select sheets corresponding to respective pages, the operator can independently set medium types for the respective pages.

Figure 6:
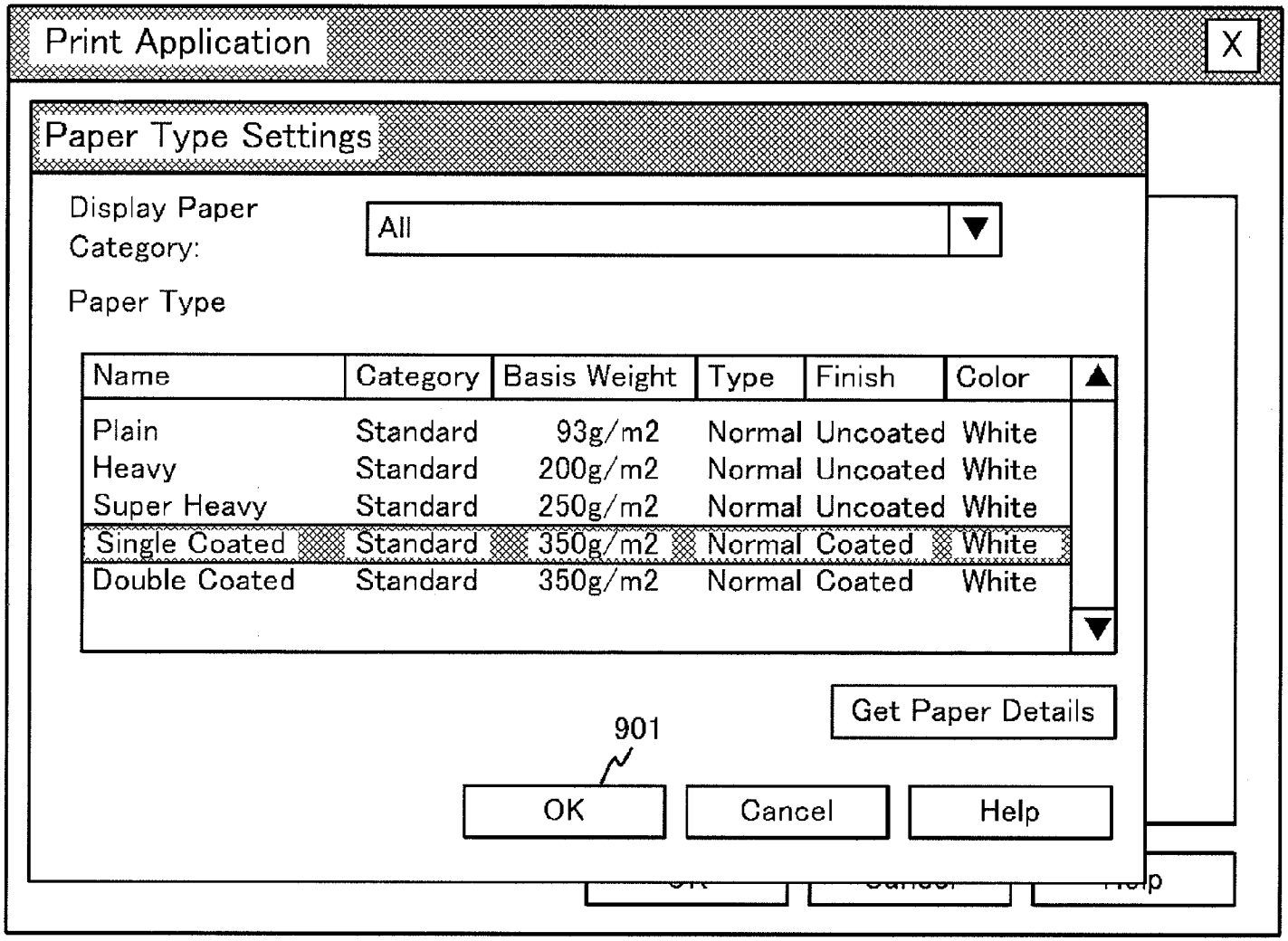
FIG. 6 is a view exemplifying a medium setting screen on the print setting screen of the print application.

FIG. 6 exemplifies a selection screen which is displayed upon pressing the Settings button 805 in FIG. 5 and used to select a medium to be applied to the first page out of pages forming an output material. As shown in FIG. 6, selectable medium types are listed together with medium information including the name and grammage. By pressing an OK button 901 while selecting a desired type of medium from the list, the operator can select a medium to be applied to the first page. FIG. 6 exemplifies a state in which single-coated paper "Single Coated" is selected. "Single Coated" corresponds to a medium 708 having a value "5" in the ID field 701 of the medium management information storage table shown in FIG. 4.

Figure 7:
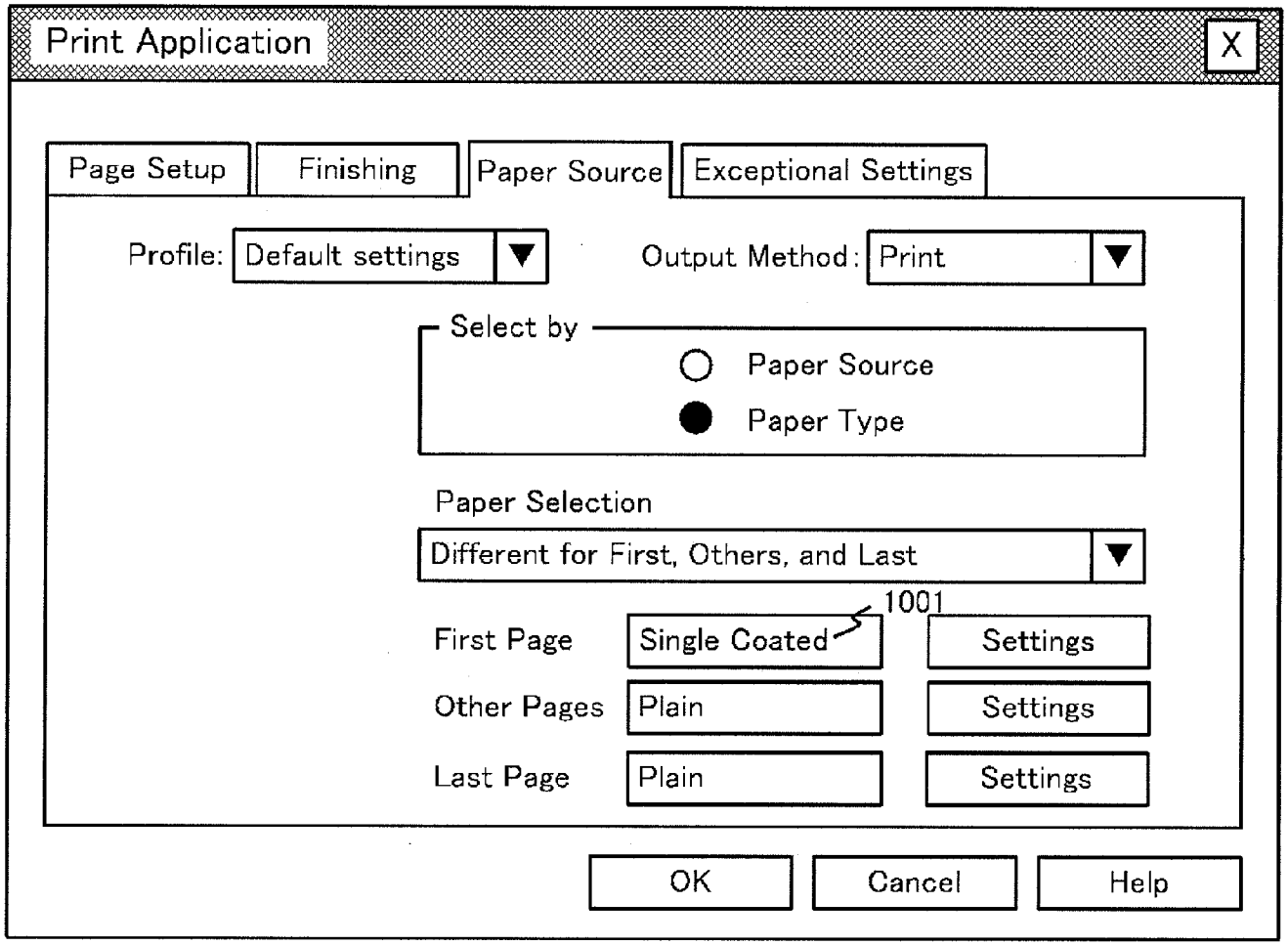
FIG. 7 is a view exemplifying a screen state after executing settings in FIG. 6 on the print setting screen of the print application.

FIG. 7 exemplifies a medium setting screen displayed when the operator presses the OK button 901 in the state shown in FIG. 6. The setting screen shown in FIG. 7 is identical to that shown in FIG. 5. However, in FIG. 6, it can be confirmed from a First Page pane 1001 that "Single Coated" indicating single-coated paper is set for only a medium to be applied to the first page out of pages forming an output material.

<Print Job Setting Data (FIGS. 8 and 9)>

FIGS. 8 and 9 exemplify print job setting data generated from medium settings when print job medium settings are made using the setting screens in FIGS. 5 to 7. FIGS. 8 and 9 are separated under a limitation on the description space, and are continuously described in practice. FIGS. 8 and 9 show print settings described in a JDF job ticket format which is a POD industry standard. However, print settings may be described in a format other than JDF. JDF print settings shown in FIGS. 8 and 9 include settings 1102 and 1105 regarding the first medium out of media used in print processing of an output material, settings 1103 and 1104 regarding the last medium, and settings 1101 and 1104 regarding all pages except for the first and last pages.

<Warning Screen upon Generation of Printing Error (FIG. 10)>

Figure 10:
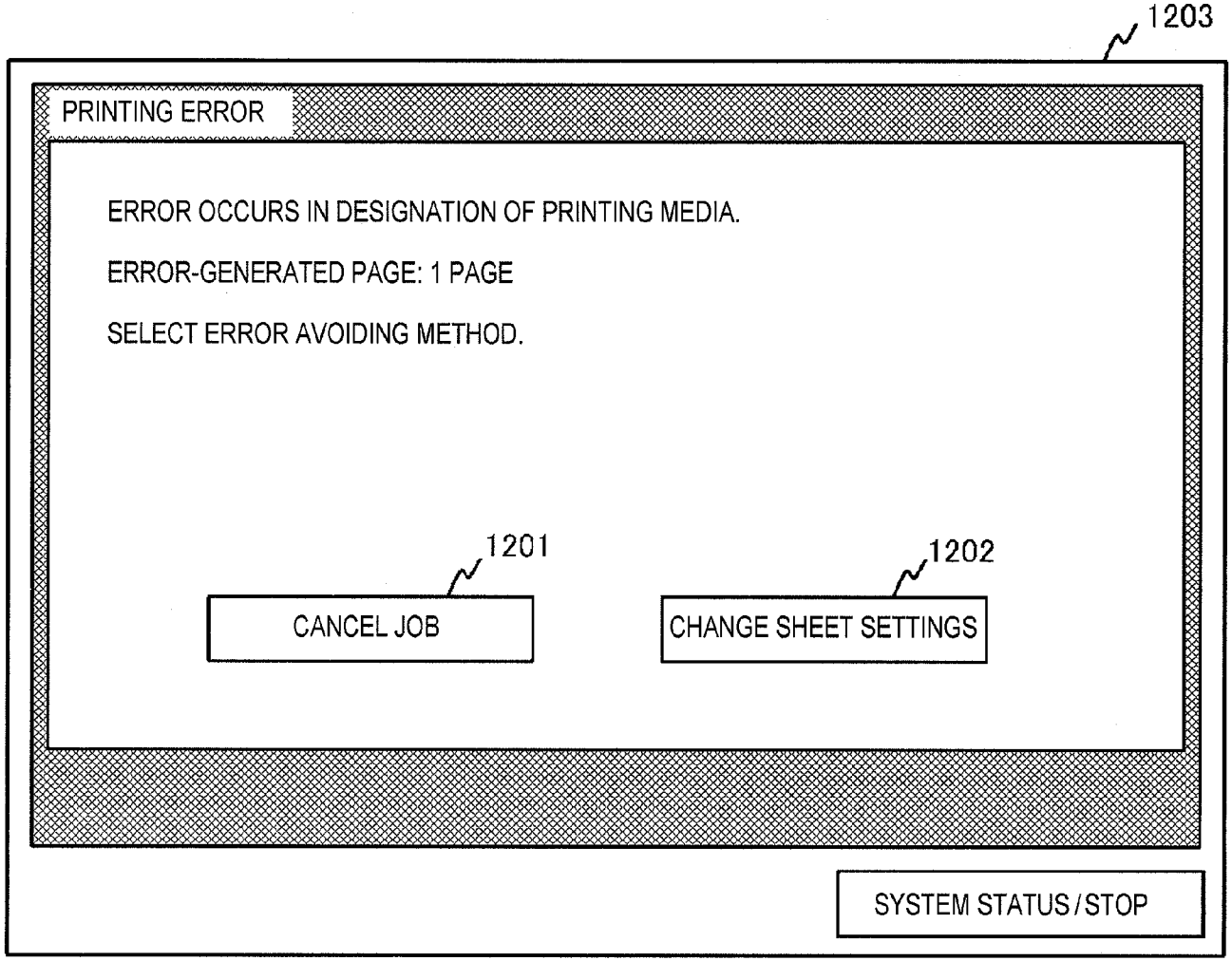
FIG. 10 is a view exemplifying a screen displayed when a medium setting error occurs.

FIG. 10 exemplifies a warning screen displayed on the operation unit 204 when the digital printer 100 receives a print job containing print settings shown in FIGS. 8 and 9 and starts execution. According to the medium management information storage table shown in FIG. 4, single-coated paper serving as a medium designated for the first page in the print settings shown in FIGS. 8 and 9 can be stored in only the feeding unit of the inserter 228 in the digital printer 100. In other words, no single-coated paper is stored in a normal feeding unit which stores media used as printing media. Hence, when a print job containing this setting is received and it is detected that the print job contains a setting having a problem in execution of print processing, a warning screen indicating a print setting error as shown in FIG. 10 is displayed on the operation unit 204 to prompt the operator to select an avoiding method. On the warning screen shown in FIG. 10, a job cancel button 1201 for interrupting a print job itself, and a sheet setting change button 1202 for changing the medium setting of a page having a medium setting error are prepared as buttons corresponding to avoiding processes to be selected by the operator. However, another avoiding processing may be selected.

<Example of Transition of Medium Setting Screen (FIGS. 11 and 12)>

Figure 11:
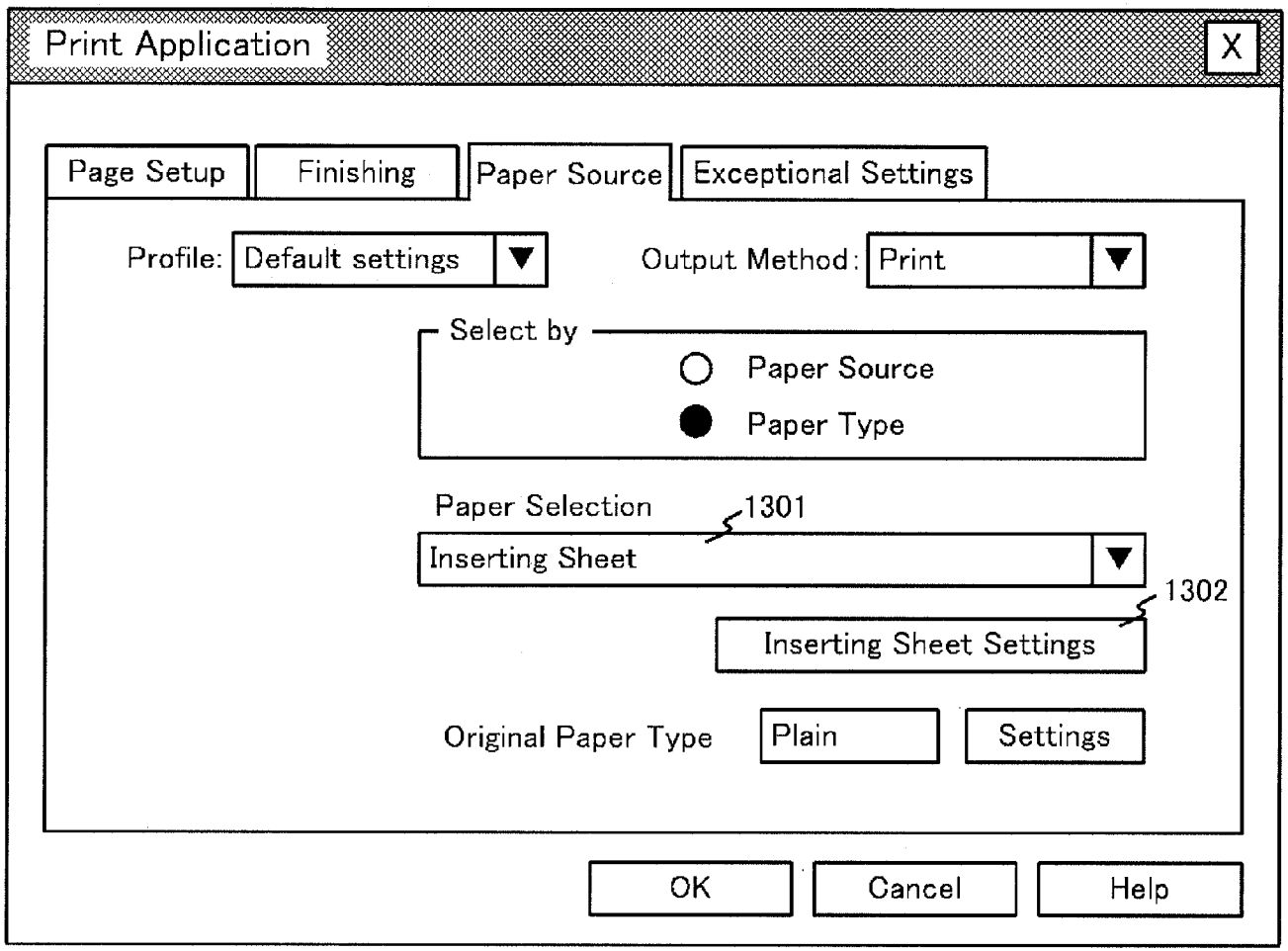
FIG. 11 is a view exemplifying a screen when setting an inserting sheet on the print setting screen of the print application.

Similar to FIG. 5, FIG. 11 exemplifies a setting screen for making settings regarding a medium used for a print job out of print job setting functions provided by the print application program. Unlike the example in FIG. 5, FIG. 11 shows a setting example of a target inserting sheet. In FIG. 11, "Inserting Sheet" is selected in a Paper Selection pane 1301, representing a mode in which inserting sheet settings are made. When the operator presses an Inserting Sheet Settings button 1302, the display screen changes to a detailed inserting sheet setting screen.

Figure 12:
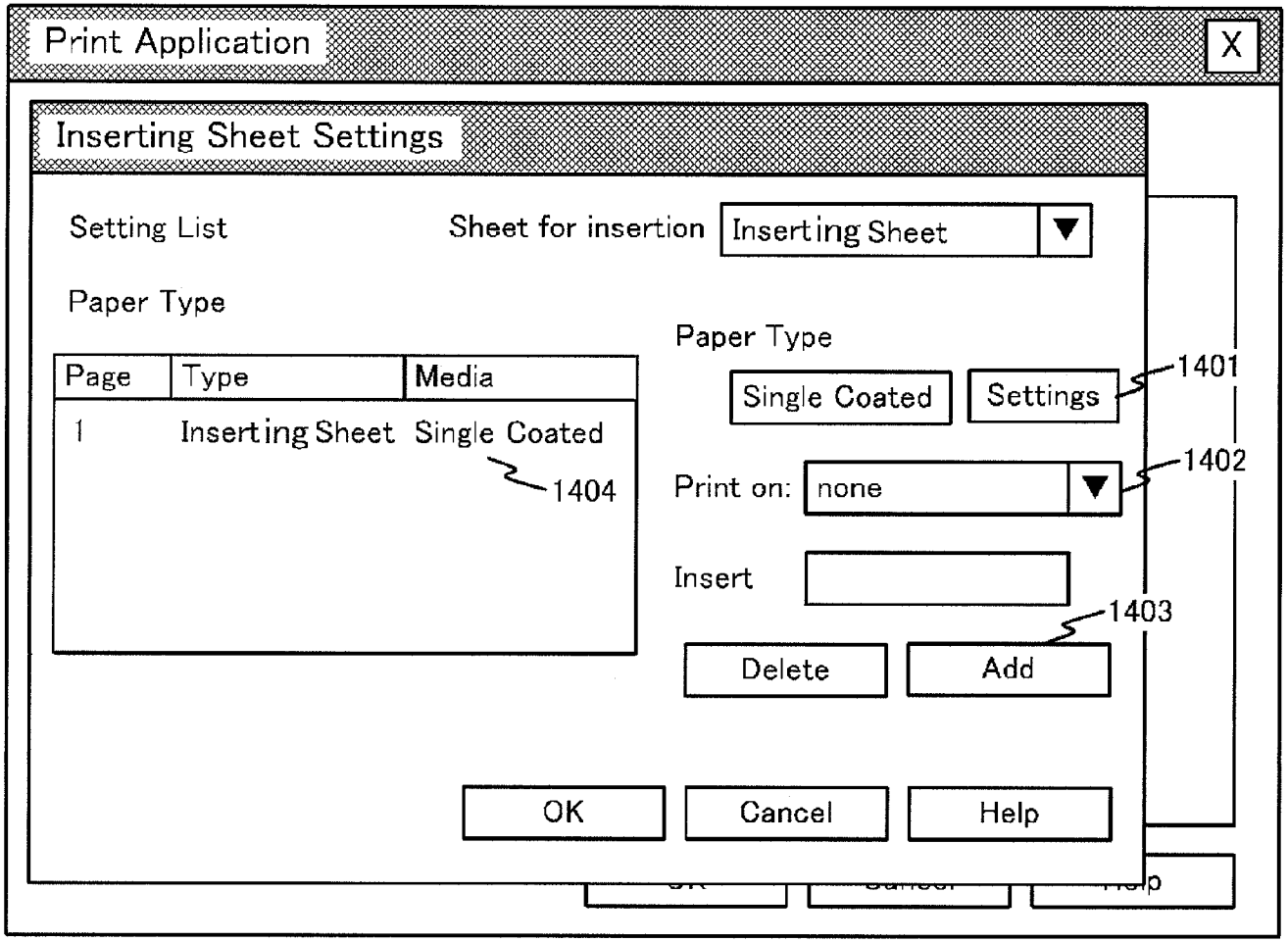
FIG. 12 is a view exemplifying a detailed inserting sheet setting screen on the print setting screen of the print application.

FIG. 12 exemplifies a detailed inserting sheet setting screen displayed upon pressing the Inserting Sheet Settings button 1302 in FIG. 11. A Paper Type pane on the detailed inserting sheet setting screen of FIG. 12 represents that the setting of the type of medium used as an inserting sheet is "Single Coated". When the operator presses a Settings button 1401 in this state, the display screen changes to a screen identical to the medium type selection screen shown in FIG. 6, and the operator can select a medium to be used as an inserting sheet. The screen displayed upon pressing the Settings button 1401 is identical to the screen shown in FIG. 6, and a detailed description thereof will not be repeated.

A Print on pane 1402 is used to set whether to print a content page on an inserting sheet. When the operator validates the setting of printing on an inserting sheet, the inserting sheet differs from one used in mere insertion processing. Since a medium is designated for a specific page in printing, a case in which the set value in this setting item is "None" (that is, no printing is performed on an inserting sheet) will be explained in the embodiment.

When the operator presses an Add button 1403 after the end of various settings for an inserting sheet, information indicating the inserting sheet setting made using the screen shown in FIG. 12 is added to a Setting List 1404 and displayed. FIG. 12 shows an example in which an inserting sheet not accompanied by printing is set for the first page and the medium type of the inserting sheet used at this time is single-coated paper.

<Print Job Setting Data (FIGS. 13 and 14)>

FIGS. 13 and 14 exemplify print job setting data generated after the medium setting of a print job using an inserting sheet is made on the setting screen of FIG. 12. Similar to the print job setting data shown in FIG. 9, FIGS. 13 and 14 exemplify print job setting data in the JDF format. However, the setting data may be described in any format other than JDF. FIGS. 13 and 14 are separated under a limitation on the description space, and are continuously described in practice. In FIGS. 13 and 14, medium settings for an inserting sheet not accompanied by printing are described at portions 1501 and 1504. Also, medium settings for pages other than an inserting sheet are described at portions 1502 and 1503.

<Operation Sequence (FIG. 15)>

Figure 15:
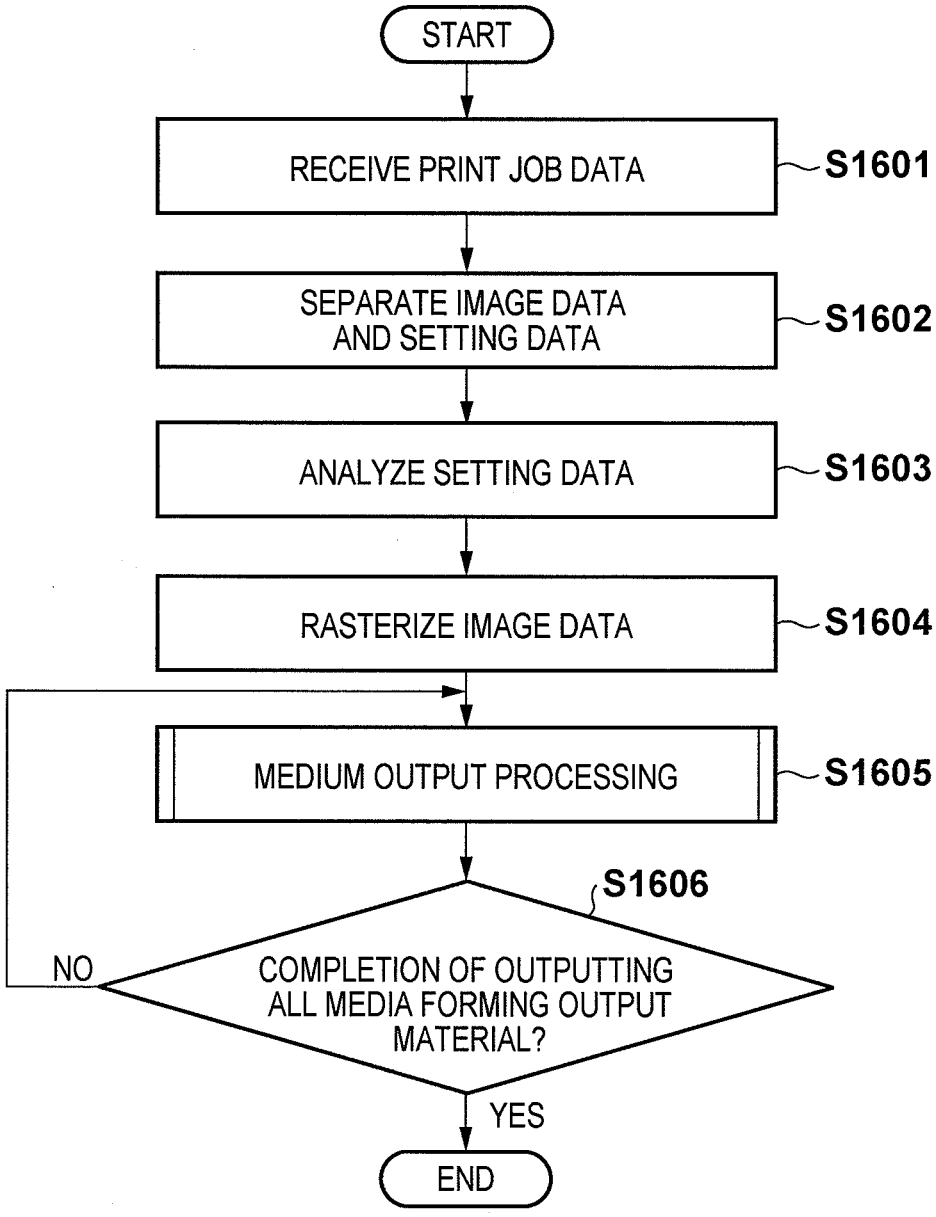
FIG. 15 is a flowchart showing a detailed operation in execution of a print function program.

FIG. 15 is a flowchart for explaining an outline of an operation complying with the JDF function program 504. The control unit 205 mainly executes the JDF function program 504. Alternatively, the functions of the respective modules shown in FIG. 2 execute the JDF function program 504 under the control of the control unit 205.

First, the external I/F 202 receives print job data based on an instruction from the control unit 205 (step S1601). In the embodiment, the received data is temporarily stored in the HDD 209, but may be held in the RAM 208.

Then, the control unit 205 separates image data and print setting data contained in the print job data received in step S1601 (step S1602). This operation is an operation by the JDF function program 504 executed by the control unit 205. In the embodiment, the print setting data corresponds to JDF print setting data shown in FIGS. 8 and 9 or FIGS. 13 and 14.

The control unit 205 analyzes the print setting data separated from the image data in step S1602 (step S1603). This operation is an operation by the JDF function program 504 executed by the control unit 205. In the embodiment, this operation corresponds to processing of analyzing print settings described in the JDF print setting data shown in FIGS. 8 and 9 or 13 and 14, and converting them into control data of an internal format directly interpretable by the digital printer 100.

The control unit 205 rasterizes the image data separated in step S1602 (step S1604). This operation is an operation by the JDF function program 504 executed by the control unit 205. This operation corresponds to processing of converting data of a format (in general, logical data of a so-called PDL format) expressed as image data into bitmap image data.

Note that the formats of the print setting data and image data described using specific formats in the above-described steps according to the embodiment are not limited to the JDF and PDL formats in the present invention.

Further, the embodiment has exemplified a JDF job as a print job. However, the present invention is also applicable to a job generated using, for example, the PDL print function program 507 and BOX function program 508.

The control unit 205 executes medium output processing based on the image data rasterized in step S1604 and instruction contents indicated by the print settings analyzed in step S1603 (step S1605). This operation is the operation of the JDF function program 504 executed by the control unit 205 and an operation executed by controlling the printer unit 203 and sheet processing unit 200 by the control unit 205. The medium output processing includes both print processing and insertion processing for an inserting sheet not accompanied by printing. The processing in step S1605 is executed for each medium forming the output material. Details of this processing will be described later.

The control unit 205 determines whether output processing is complete for all media forming the output material (step S1606). If the determination result is true (YES), the print job execution processing shown in the flowchart ends. If the determination result is false (NO), the process returns to step S1605 to continuously execute the medium output processing for the remaining media which have not been output.

<Detailed Operation Sequence in Step S1605 (FIG. 16)>

Figure 16:
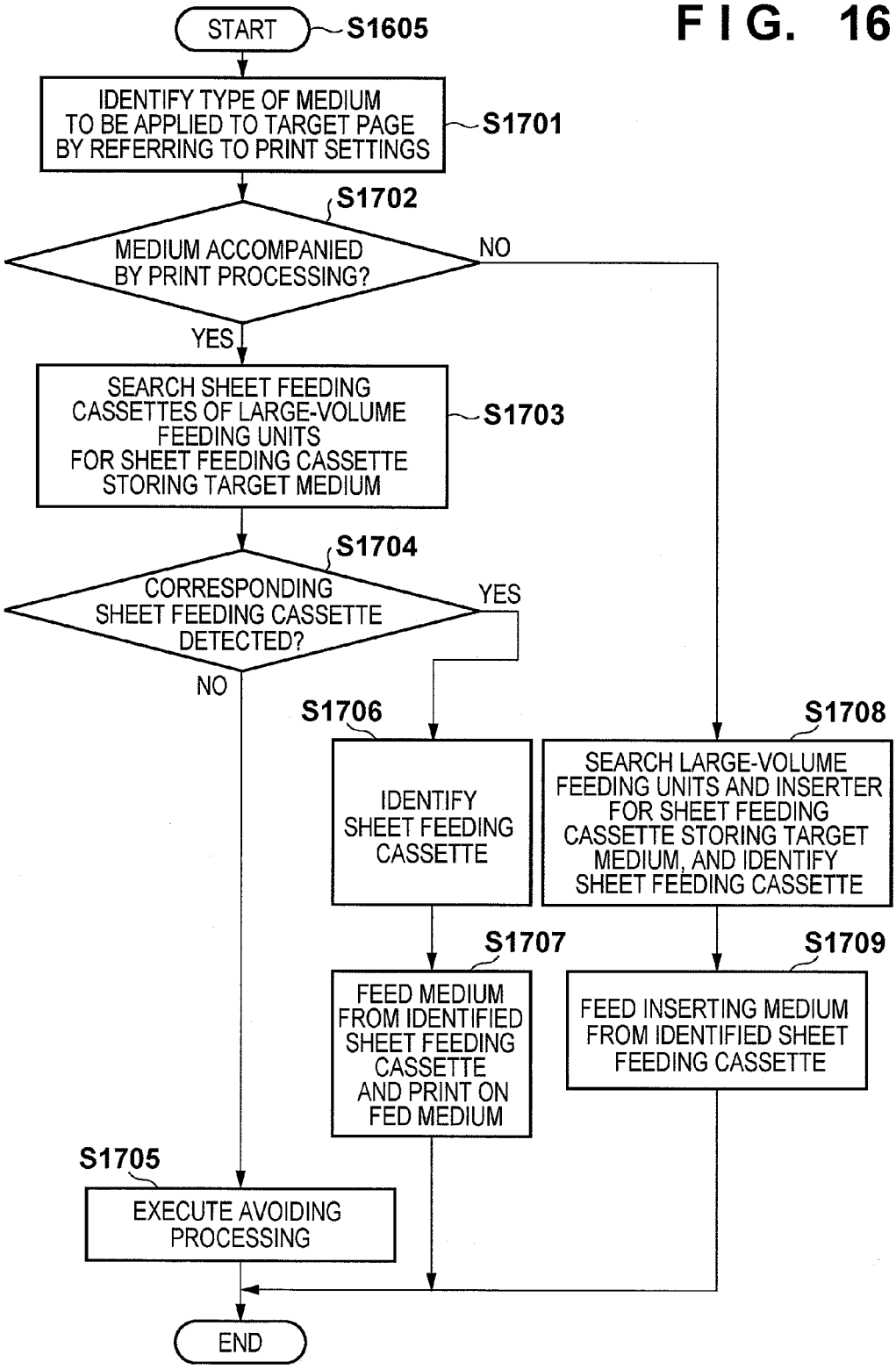
FIG. 16 is a flowchart showing a detailed operation in medium output processing (step S1605)

FIG. 16 is a flowchart for explaining determination of a medium for each page forming an output material and a job execution operation using the medium in execution of a print job in the digital printer, which is executed by the control unit 205 and medium management unit 211.

As described in association with step S1606, this flowchart is directed to processing for each medium. In practice, the entire print job is executed by performing an operation described in this sequence for all media forming the entire output material.

First, the control unit 205 identifies the type of medium to be output next, based on the result of analyzing print setting data contained in received print job data (step S1701). As described above, the print setting data analysis result is obtained in steps S1602 and S1603.

Then, the control unit 205 determines whether the medium identified in step S1701 is a medium accompanied by print processing (step S1702). That is, the control unit 205 determines whether the medium to be output is an inserting medium not accompanied by print processing.

If the control unit 205 determines in step S1702 that the medium to be output is an inserting medium not accompanied by print processing, sheet feeding cassettes on the preceding stage (that is, the large-volume feeding units 221 to 223) of the printer main body 1000 and a sheet feeding cassette on the succeeding stage (that is, the inserter 228) can be used as paper sources. In this case, the control unit 205 searches all sheet feeding cassettes for a sheet feeding cassette capable of feeding media of a type designated by print setting data for the target page, and identifies it (step S1708). The control unit 205 feeds an inserting medium from the identified sheet feeding cassette (step S1709). Upon completion of feeding, the control unit 205 advances the process to step S1606 of FIG. 15.

If the control unit 205 determines in step S1702 that the medium to be output is a medium accompanied by print processing, the medium to be output is an inserting medium accompanied by printing or a normal medium accompanied by printing. In this case, the control unit 205 advances the process to step S1703, and searches sheet feeding cassettes on the preceding stage (that is, the large-volume feeding units 221 to 223) of the printer main body for a sheet feeding cassette storing a medium to be output. More specifically, the control unit 205 searches for a sheet feeding cassette by checking the medium field in the medium management information storage table shown in FIG. 4 that is managed by the medium management unit 211.

Based on the search result in step S1703, the control unit 205 determines whether there is a corresponding sheet feeding cassette (step S1704). If the control unit 205 determines that there is a corresponding sheet feeding cassette, print processing can be executed because a medium of a type to be output can be fed to the printer unit 203 from one of the large-volume feeding units 221 to 223 positioned on the preceding stage of the printer main body 1000. In this case, the control unit 205 advances the process to step S1706 to search the sheet feeding cassettes of the large-volume feeding units 221 to 223 for a sheet feeding cassette capable of feeding media of a type designated by print setting data for the target page, and identifies it. Thereafter, the control unit 205 advances the process to step S1707 to feed a medium from the identified sheet feeding cassette and perform print processing for the medium. Upon completion of processing, the control unit 205 advances the process to step S1606 of FIG. 15.

A case in which it is determined in step S1704 that there is no corresponding sheet feeding cassette is equivalent to a case in which a medium of a type to be output cannot be fed to the printer unit 203 from the large-volume feeding units 221 to 223 positioned on the preceding stage of the printer main body 1000. In this case, no print processing can be executed. Thus, the control unit 205 advances the process to step S1705 to interrupt the print job execution processing and execute avoiding processing. As described with reference to FIG. 10, the avoiding processing is processing of displaying, on the operation unit 204, a screen which warns the operator that an error has occurred, and prompting him to select whether to cancel the received print job or change the medium.

Second Embodiment

The first embodiment has described an example of canceling an error generated upon designating print processing when media designated in execution of a print job can be stored in only a feeding unit arranged on the succeeding stage of the printer main body 1000 among feeding units arranged on the preceding and succeeding stages of the printer main body 1000. To the contrary, the second embodiment will describe a solution to a problem arising from the possibility of generating two cases, that is, a case in which print processing is performed for a preprinted sheet and a case in which no print processing is performed for it when the preprinted sheet is stored in a feeding unit arranged on the preceding stage of a printer main body 1000. As for the arrangement of a digital printer 100, a description of a part common to the arrangement of the digital printer 100 according to the first embodiment will not be repeated. The second embodiment will be explained by referring to a corresponding portion in the first embodiment, as needed.

<Medium Management Screen (FIG. 17)>

Figure 17:
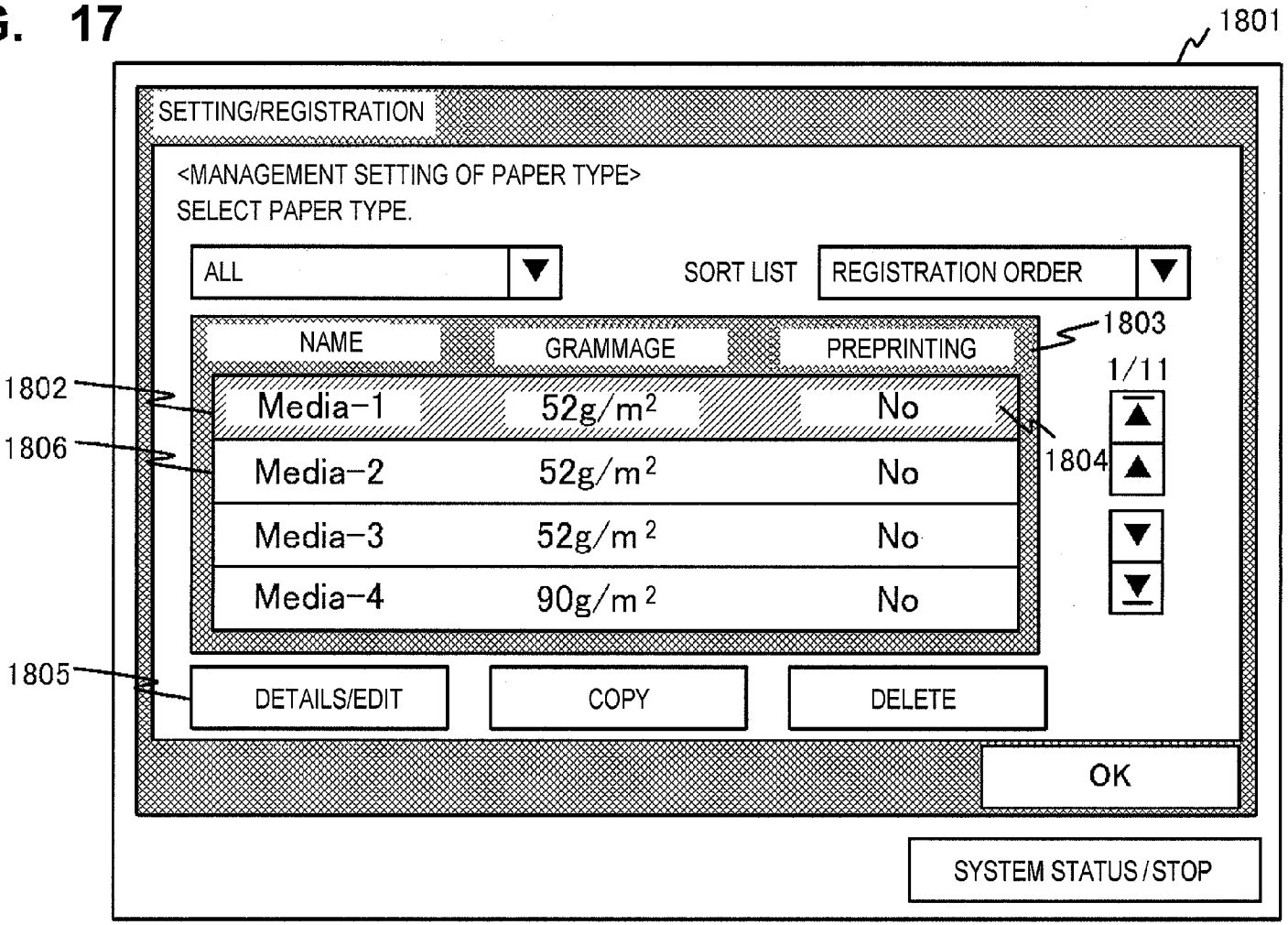
FIG. 17 is a view exemplifying the medium management screen of a digital printer according to the second embodiment of the present invention.

FIG. 17 exemplifies a medium management screen 1801 of the digital printer 100 that is displayed on an operation unit 204 under the control of a control unit 205 and medium management unit 211. As shown in FIG. 17, information including the name, grammage, and a preprinted sheet setting 1803 is displayed on a list together with part of medium management information for each medium type which is registered and managed in the digital printer 100. FIG. 17 exemplifies a list of information about four medium types out of all medium types registered in the digital printer 100. In FIG. 17, a type at the top of the list, that is, a medium type having a name "Media-1" 1802 is highlighted and this medium type is selected. For the Media-1 1802, "No" is set in the preprinted sheet setting field and represents that the Media-1 1802 is not a preprinted sheet. By pressing a details/edit button 1805 in this state, the operator can edit various kinds of medium management information about the highlighted medium type Media-1 1802. Note that information of each medium shown in FIG. 17 is held in a medium management information storage table stored in an HDD 209 under the management of the medium management unit 211. The medium management information held in this table will be described later.

<Medium Management Information Storage Table (FIG. 18)>

FIG. 18 exemplifies information held in a table which is managed by the medium management unit 211, held in the HDD 209, and stores medium management information. Although this table corresponds to the medium management information storage table described with reference to FIG. 4 in the first embodiment, the stored medium management information is different from the above-described one. However, the pieces of medium management information described in the first and second embodiments do not depend on the specific contents, and are used essentially for the same purpose.

The roles of respective fields in the medium management information storage table shown in FIG. 18 will be explained. An ID field 1901 is a field for storing an ID assigned to each type of medium usable by the digital printer 100. In the digital printer 100, the usable medium type is unitarily managed by an ID stored in the ID field of the medium management information storage table.

A name field 1902 is a field for storing a name character string which is assigned to a medium type identified by an ID stored in the ID field 1901 and is used to identify a medium type. A character string stored in this field is assumed to be used for screen display when the operator makes various settings regarding the medium type mainly using the operation unit 204. However, the application purpose of the character string is not limited to this.

A grammage field 1903 is a field for storing information about the grammage of a medium of a type identified by an ID stored in the ID field 1901. A surface property field 1904 is a field for storing information about the surface property of a medium of a type identified by an ID stored in the ID field 1901. A color field 1905 is a field for storing information about the color of a medium of a type identified by an ID stored in the ID field 1901. A preprinting field 1906 is a field for storing information about whether a medium of a type identified by an ID stored in the ID field 1901 is a preprinted sheet. If a value stored in the preprinting field 1906 is "No", this means that the medium is not a preprinted sheet; if it is "Yes", this means that the medium is a preprinted sheet. In the example of FIG. 18, none of media of four types corresponding to IDs "1" to "4" are a preprinted sheet.

A preprinted sheet printing enable/disable field 1907 is a field for storing a setting indicating whether printing on a medium is enabled/disabled when the preprinting field 1906 indicates a preprinted sheet for a medium of a type identified by an ID stored in the ID field 1901. The preprinted sheet printing enable/disable field 1907 can take three values. First, for a medium which has a value "Yes" in the preprinting field 1906 and is a preprinted sheet, "Enable" representing permission of printing on a preprinted sheet can be stored. Second, for a medium which has a value "Yes" in the preprinting field 1906 and is a preprinted sheet, "Disable" representing inhibition of printing on a preprinted sheet can be stored. Third, for a medium which has a value "No" in the preprinting field 1906 and is not a preprinted sheet, "N/A" indicative of this can be stored. Therefore, the preprinted sheet printing enable/disable field 1907 becomes significant only when the value in the preprinting field 1906 is "Yes". When the value in the preprinting field 1906 is "No", a special value ("N/A") indicating that the value is insignificant is set in the preprinted sheet printing enable/disable field 1907.

<Medium Management Information Edit Screen (FIG. 19A)>

Figure 19A:
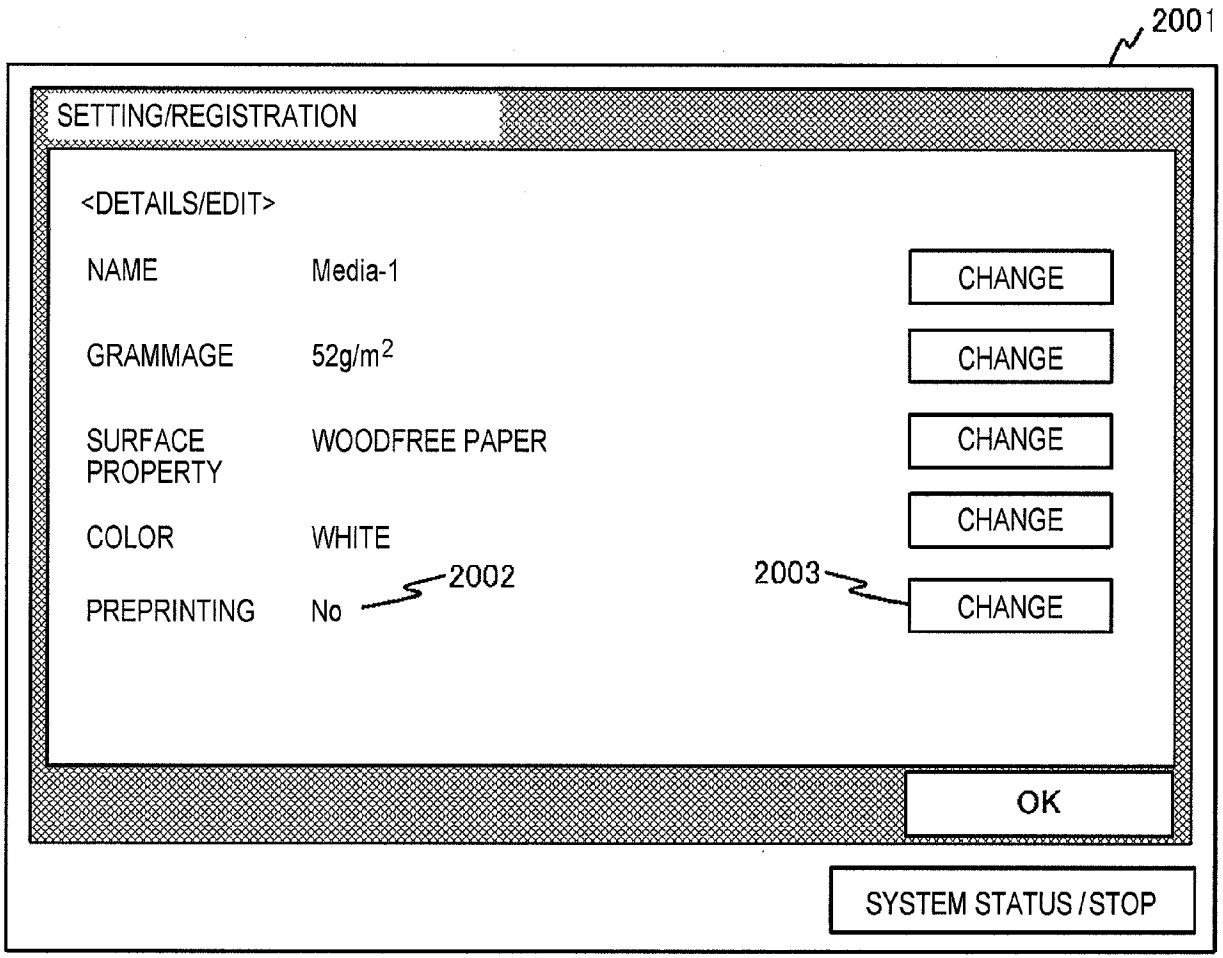
FIG. 19A is a view exemplifying the medium information change screen of a medium management screen.

FIG. 19A exemplifies a medium management information edit screen for the Media-1 1802 that is displayed immediately after pressing the details/edit button 1805 on the screen shown in FIG. 17. As shown in FIG. 19A, pieces of medium management information managed by the digital printer 100 are listed and the current settings can be confirmed for each medium management information. At the same time, a change button is prepared to press it for editing, as needed. A preprint setting 2002 displayed at the end of medium-related attributes for the Media-1 1802 in FIG. 19A is "No" even in FIG. 19A, similar to FIGS. 17 and 18. This means that the Media-1 1802 is not a preprinted sheet. A change button 2003 is used to change the display screen to a change screen for changing the set value of the preprint setting 2002 for the Media-1 1802.

<Change Screen (FIG. 19B)>

Figure 19B:
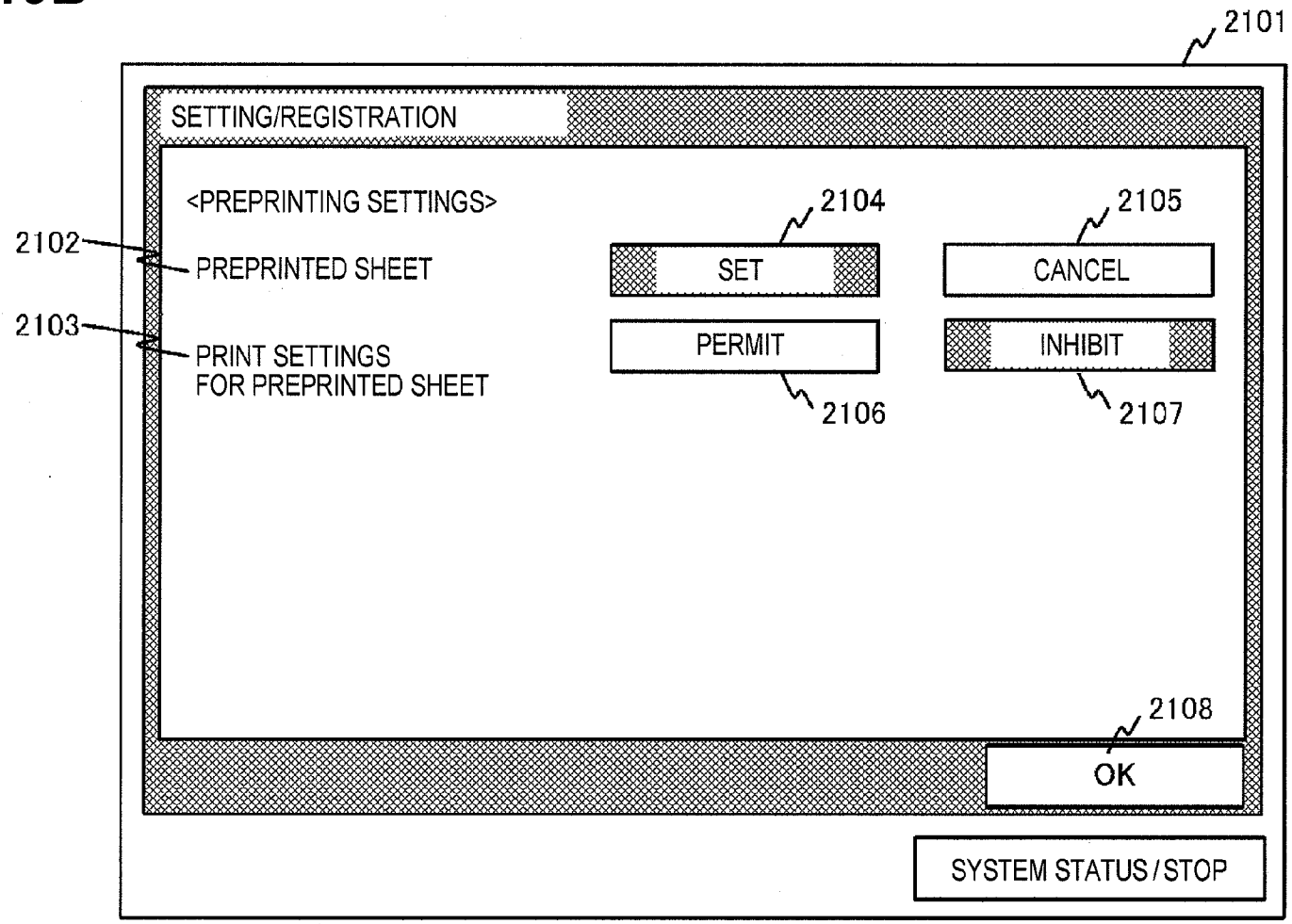
FIG. 19B is a view exemplifying a setting change screen regarding a preprinted sheet out of the medium information change screen.

FIG. 19B exemplifies a change screen which is displayed immediately after pressing the change button 2003 in FIG. 19A, and used to change setting information about preprinted sheet settings. Two types of settings 2102 and 2103 are changeable on the change screen shown in FIG. 19B. First, a setting indicating whether the target medium type is a preprinted sheet is changeable. This setting is changed by pressing either a setting button 2104 or cancel button 2105. The medium is managed as a preprinted sheet when the operator presses the setting button 2104, and managed not as a preprinted sheet when he presses the cancel button 2105. Second, it can be set whether to permit print processing for a preprinted sheet. Printing on a preprinted sheet is permitted when the operator presses a permission button 2106, and inhibited when he presses an inhibition button. Pieces of information indicating pressing of the setting button 2104, the cancel button 2105, the permission button 2106, and an inhibition button 2107 are reflected in corresponding fields in the medium management information storage table shown in FIG. 18 in accordance with the pressing states of the respective buttons after pressing an OK button 2108. As the preprint settings of the Media-1 1802, the screen example shown in FIG. 19B represents that a setting of a preprinted sheet as the target medium and a setting of inhibiting printing are made on the same screen.

<Medium Management Screen (FIGS. 20A, 20B, and 21)>

Figure 20A:
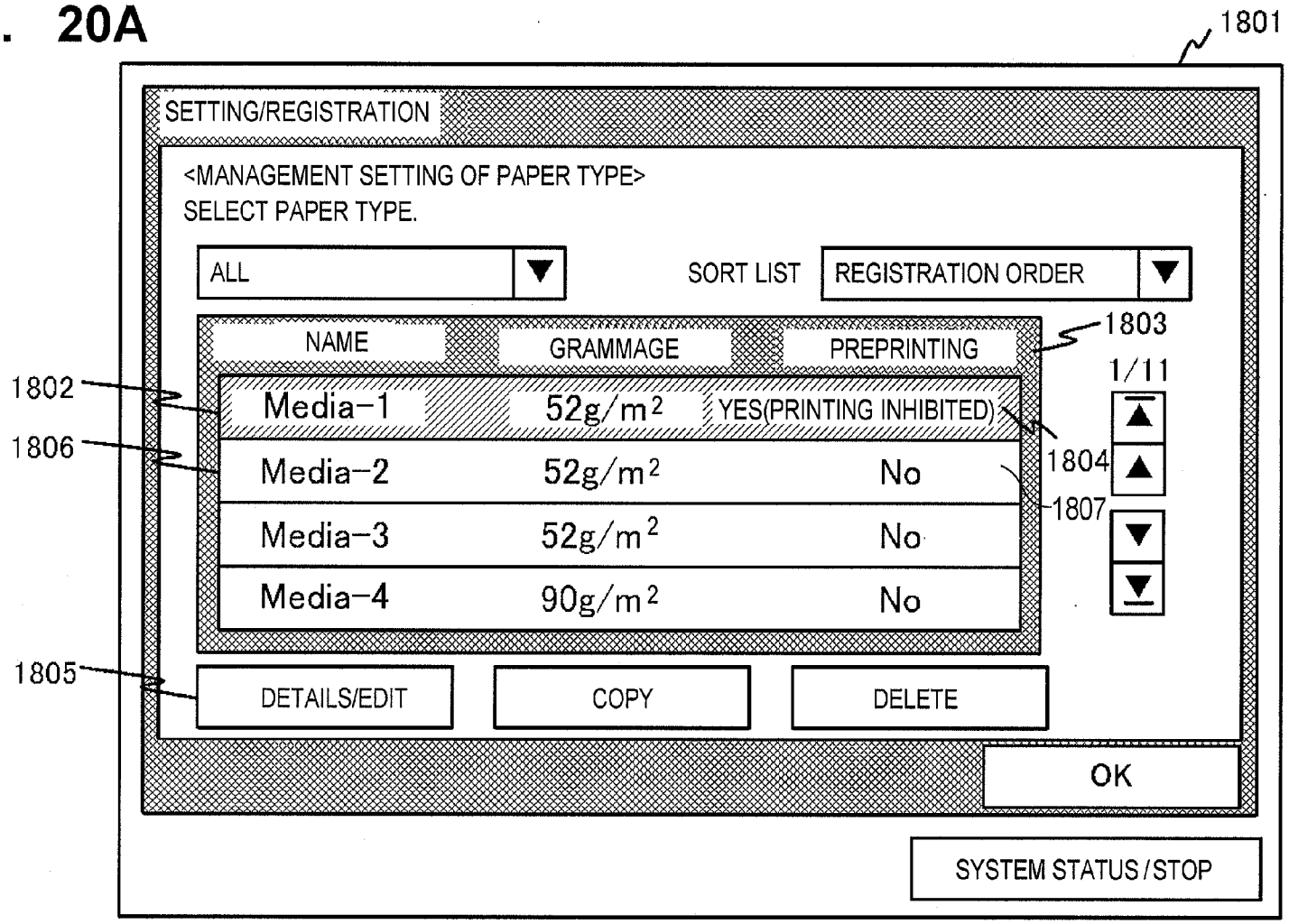
FIG. 20A is a view exemplifying a screen displayed after changing medium information on the medium information change screen of the medium management screen.

FIG. 20A exemplifies a medium management screen after changing the preprint settings of the Media-1 1802, which is displayed immediately after pressing the OK button on the setting screen shown in FIG. 19A. As shown in FIG. 20A, the screen example shown in FIG. 17 switches to a display in which the value in the preprinting field for the Media-1 1802 indicates a preprinted sheet and printing on the preprinted sheet is inhibited.

Figure 20B:
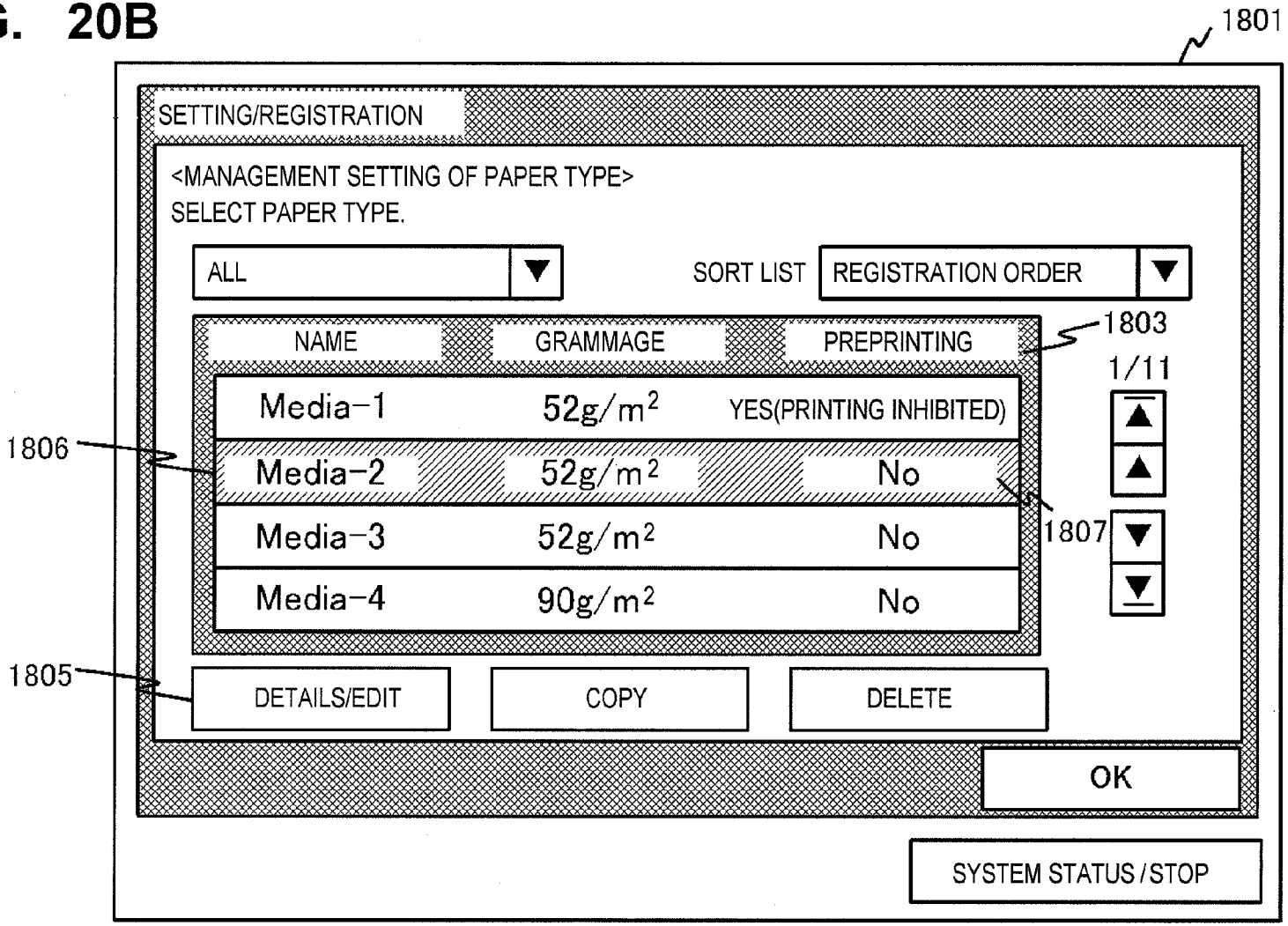
FIG. 20B is a view exemplifying a medium information change screen when executing medium change processing, which is different from that in FIG. 20A.

FIG. 20B exemplifies a screen state in which Media-2 1806 is selected and highlighted in the medium management screen shown in FIG. 20A. In this screen state, when the operator presses the details/edit button 1805, various kinds of medium management information about the Media-2 1806 can be edited. As shown in FIG. 20B, the preprint setting of the Media-2 1806 before pressing the details/edit button 1805 is "No" (1807).

<Change Screen (FIG. 21)>

Figure 21:
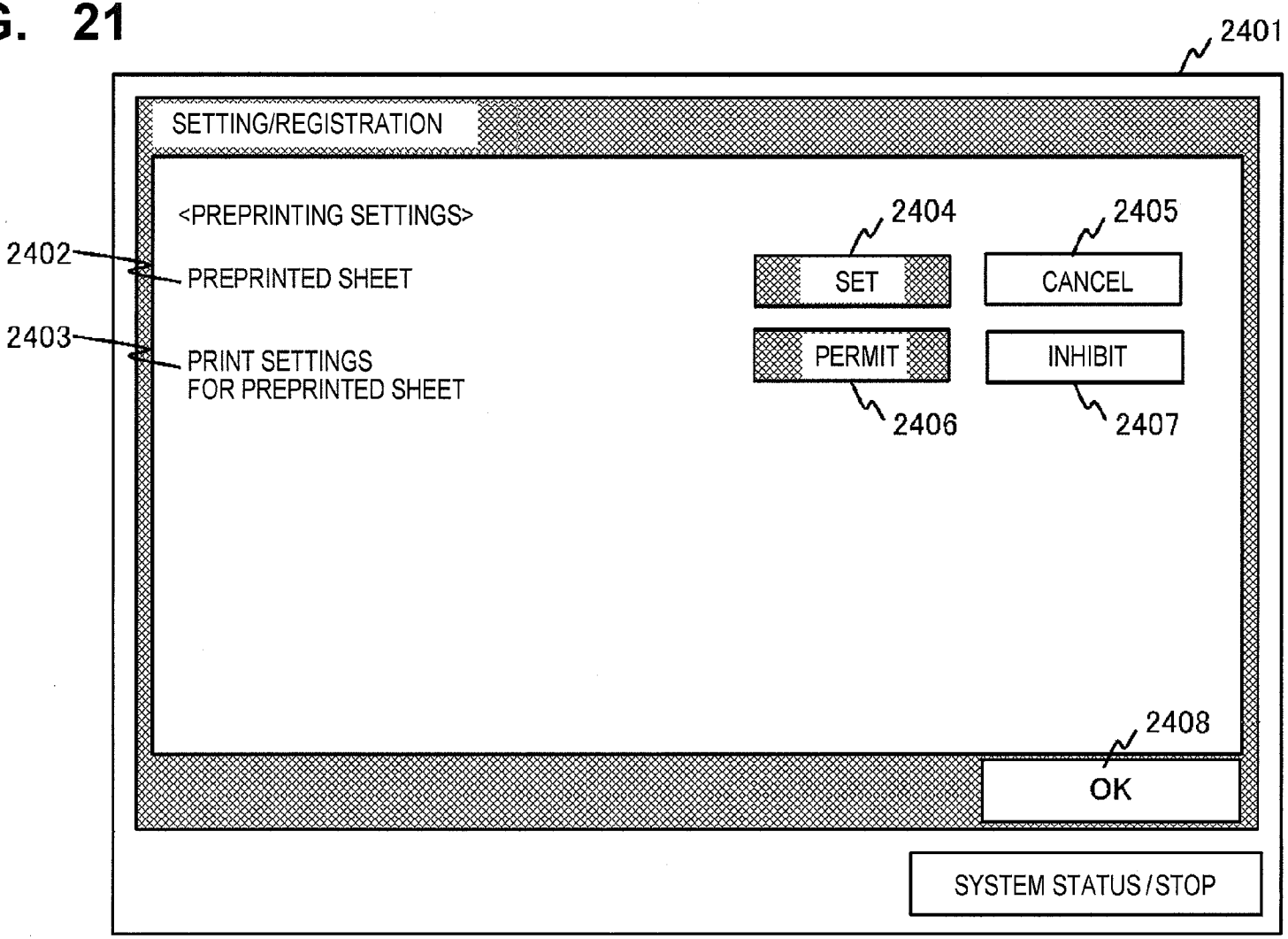
FIG. 21 is a view showing a state in which settings different from the state shown in FIG. 19B are made on a setting information change screen regarding a preprinted sheet out of the medium information change screen of the medium management screen.

FIG. 21 exemplifies a change screen for changing setting information about preprinted sheet settings of the Media-2 1806. During screen transition to this screen, a screen identical to that shown in FIG. 19A is displayed, details of which have been described in the setting change example of the Media-1 1802 and a description of which will not be repeated. In FIG. 21, unlike the case of the Media-1 1802 in FIG. 19B, a setting of a preprinted sheet as the target medium and a setting of permitting printing on the preprinted sheet are made on this screen as the preprint settings of the Media-2 1806.

<Medium Management Screen (FIG. 22)>

Figure 22:
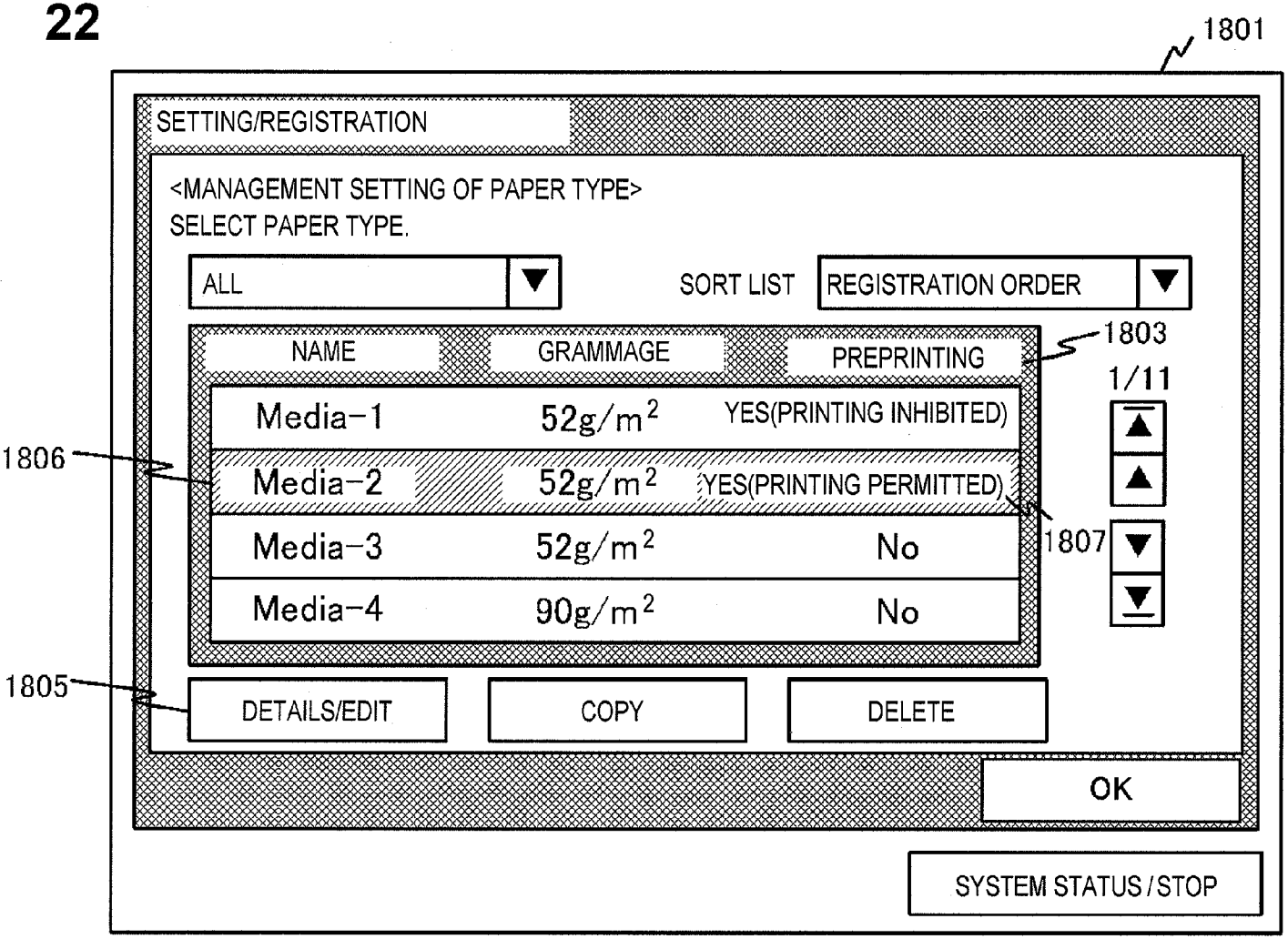
FIG. 22 is a view exemplifying a medium management screen displayed after executing setting change processing shown in FIG. 21.

FIG. 22 exemplifies a medium management screen after changing the preprint settings of the Media-2 1806, which is displayed immediately after pressing an OK button 2408 on the setting screen shown in FIG. 21. In FIG. 22, unlike the screen example shown in FIG. 20A, the display in the preprinting field for the Media-2 1806 switches to a display meaning that the target medium is a preprinted sheet and printing on the preprinted sheet is permitted.

<Medium Management Information Storage Table (FIG. 23)>

FIG. 23 exemplifies information held in the medium management information storage table after executing the screen operations in FIGS. 17 and 19A to 22. A comparison with contents in the fields of a Media-1 1908 and Media-2 1909 in the medium management information storage table shown in FIG. 18 reveals that the values in the preprinting field 1906 and preprinted sheet printing enable/disable field 1907 have been changed based on the operation contents on the above-described operation screens, respectively.

<Detailed Operation Sequence in Setting Data Analysis Processing (step S1603) (FIG. 24)>

Figure 24:
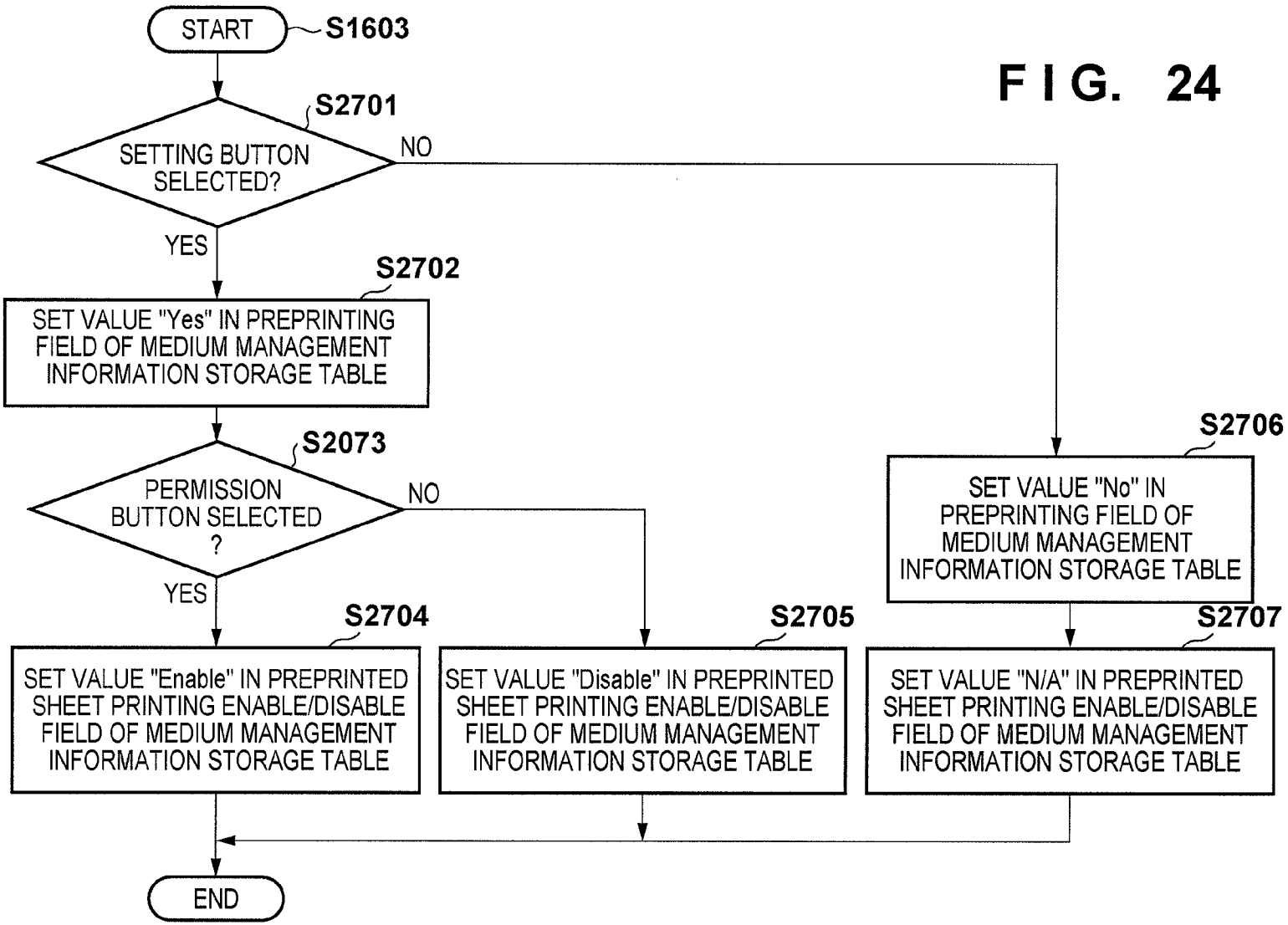
FIG. 24 is a flowchart showing a detailed operation in setting data analysis processing (step S1603)

FIG. 24 is a flowchart showing a detailed sequence when changing the set value in the preprint setting-related field of the medium management information storage table shown in FIG. 18 or 23 for the type of medium whose settings are to be changed after pressing the OK button on the screen of FIG. 19B or 21. Each processing shown in FIG. 24 is executed under the control of the control unit 205.

First, the control unit 205 determines whether the setting button 2104 or a setting button 2404 has been selected on the setting change screen in FIG. 19B or 21 (step S2701). If the setting button 2104 or 2404 has been selected, this means that a preprinted sheet is set as the target medium. In this case, the control unit 205 sets a value "Yes" in the preprinting field 1906 for the corresponding medium type in the medium management information storage table (step S2702). Then, the control unit 205 determines whether the permission button 2106 or a permission button 2406 has been selected on the setting change screen in FIG. 19B or 21 (step S2703). If the permission button 2106 or 2406 has been selected, this means that printing on the preprinted sheet is permitted. In this case, the control unit 205 sets a value "Enable" in the preprinted sheet printing enable/disable field 1907 for the corresponding medium type in the medium management information storage table (step S2704).

If neither the permission button 2106 nor 2406 has been selected, this means that the inhibition button 2107 or an inhibition button 2407 has been pressed. That is, printing on the preprinted sheet is inhibited. In this case, the control unit 205 sets a value "Disable" in the preprinted sheet printing enable/disable field 1907 for the corresponding medium type in the medium management information storage table (step S2705).

If neither the setting button 2104 nor 2404 has been selected in step S2701, this means that the cancel button 2105 or a cancel button 2405 has been pressed. That is, no preprinted sheet is set as the target medium. In this case, the control unit 205 sets a value "No" in the preprinting field 1906 for the corresponding medium type in the medium management information storage table (step S2706). After that, the control unit 205 sets a value "N/A" in the preprinted sheet printing enable/disable field 1907 of the medium management information storage table (step S2707).

<Detailed Operation Sequence in Medium Output Processing (step S1605) (FIG. 25)>

Figure 25:
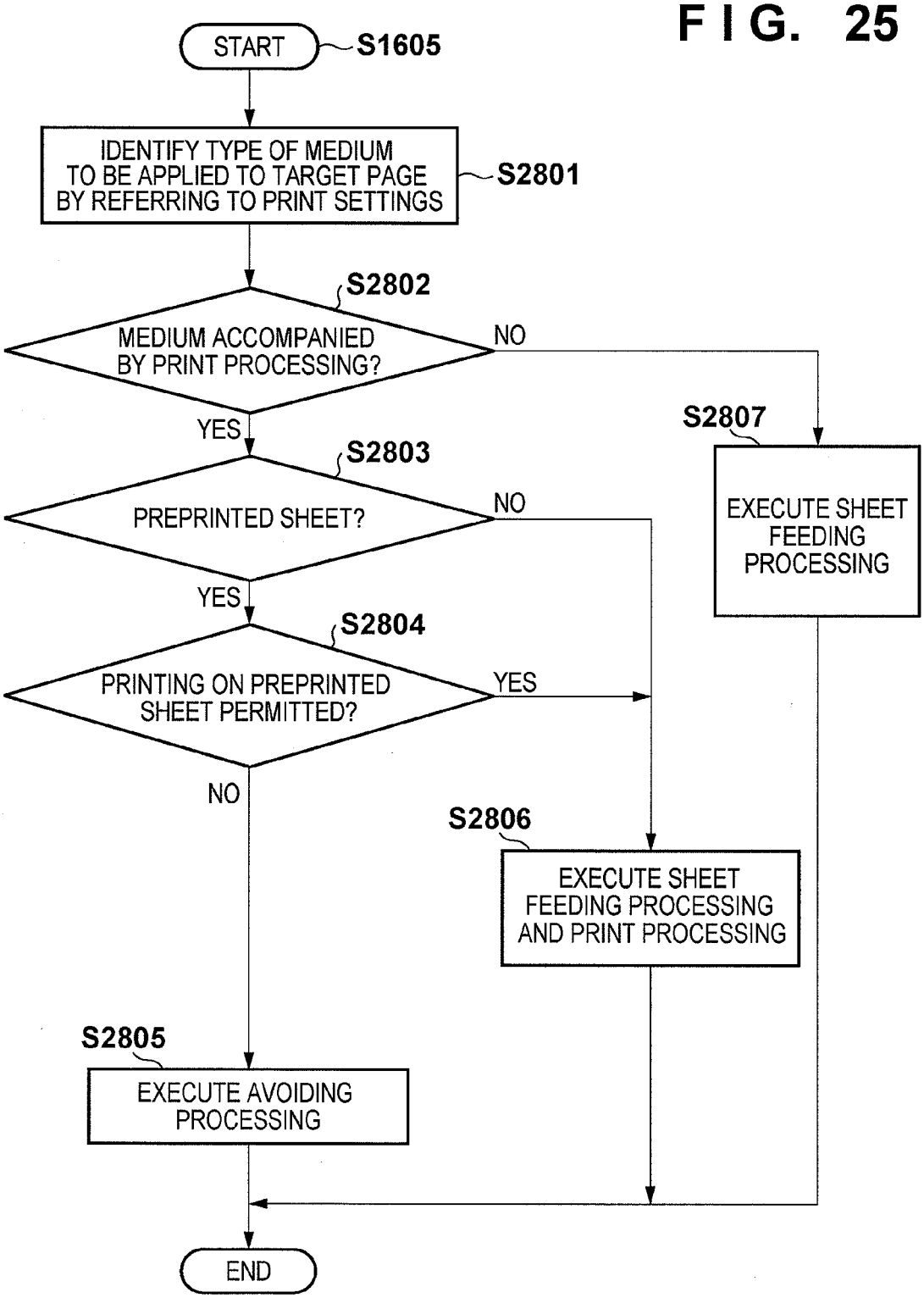
FIG. 25 is a flowchart showing a detailed operation in medium output processing (step S1605).

FIG. 25 is a flowchart showing an operation regarding determination of a medium to be used for each page forming an output material and execution of a job using the medium in execution of a print job in the digital printer 100. Similar to the sequence shown in FIG. 16 in the first embodiment, each processing described in this sequence is executed for each medium. In practice, the entire print job is executed by performing the operation of this sequence for all media forming the entire output material, as described above. Thus, a description of the same contents as those in the first embodiment will not be repeated.

First, the control unit 205 identifies the type of medium to be applied to a page to be output in execution of a print job (step S2801). Then, the control unit 205 determines whether the medium identified in step S2801 is a medium accompanied by print processing (step S2802). That is, the control unit 205 determines whether the medium to be output is an inserting medium. If the control unit 205 determines that the medium to be output is a medium not accompanied by print processing (that is, an inserting sheet), the control unit 205 executes sheet feeding processing for the designated medium (step S2807).

If the control unit 205 determines that the medium to be output is a medium accompanied by print processing (that is, not an inserting sheet), the control unit 205 determines whether the type of medium to be applied to a page to be output that has been identified in step S2801 is a preprinted sheet (step S2803). The control unit 205 executes this determination processing by checking the preprinting field 1906 corresponding to the type of medium to be output among pieces of information managed in the medium management information storage table shown in FIG. 18 or 23.

If the control unit 205 determines that the type of medium to be applied to a page to be output is not a preprinted sheet, it controls the printer unit 203 to feed a medium of this type and form the image of the target page on the fed medium (step S2806).

If the control unit 205 determines that the type of medium to be applied to a page to be output is a preprinted sheet, it determines whether printing on the preprinted sheet is permitted among preprinted sheet-related settings for the type of medium to be applied to a page to be output (step S2804). The control unit 205 executes this determination processing by checking the preprinted sheet printing enable/disable field 1907 corresponding to the type of medium to be output among pieces of information managed in the medium management information storage table shown in FIG. 18 or 23.

If the control unit 205 determines that printing on the preprinted sheet to be applied to a page to be output is permitted, it advances the process to step S2806 and controls the printer unit 203 to feed a medium of this type and form the image of the target page on the fed medium. This sequence is executed assuming a form in which when a preprinted sheet is designated as a printing medium, it is used as a printing medium because printing is permitted.

If the control unit 205 determines in step S2804 that printing on the preprinted sheet to be applied to a page to be output is inhibited, it interrupts print job execution processing and starts avoiding processing as alternative processing without starting a sheet feeding operation, unlike step S2806 or S2807 (step S2805).

This sequence is executed assuming a form in which when a preprinted sheet is designated as a printing medium, the use of the preprinted sheet as a printing medium is inhibited because printing is inhibited. This processing can prevent erroneous use of a preprinted sheet not to erroneously execute print processing for an inserting preprinted sheet assumed not to undergo print processing. An example of detailed contents of avoiding processing executed in this processing corresponds to processing of displaying the screen shown in FIG. 12 in the first embodiment.

The present invention is not limited to the above embodiments, and various modifications (including organic combinations of the embodiments) can be made based on the gist of the present invention and are not excluded from the scope of the present invention. For example, in the above embodiments, the control unit 205 in the digital printer 100 serves as the main processor of various control operations. However, an external controller or the like in a housing different from the digital printer may execute some or all of these control operations.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-007314, filed Jan. 17, 2011, which is hereby incorporated by reference herein in its entirety.

What is claimed is:

1. A printing apparatus comprising:

a setting unit configured to set, based on a designation by a user, whether to permit or unexceptionally inhibit print processing for a preprinted sheet which can be used as any of an inserting sheet and a print target;

an accepting unit configured to accept a print job;

a determining unit configured to determine, in a case where the preprinted sheet is designated in the print job and the preprinted sheet is used not as the inserting sheet but as the print target, whether or not to perform the print processing for the preprinted sheet, based on a result of setting by the setting unit; and a processing unit configured to perform the print processing for the preprinted sheet in a case where the determining unit has determined to perform the print processing for the preprinted sheet; and to cancel the print job in a case where the determining unit has determined not to perform the print processing for the preprinted sheet, wherein in the case where the preprinted sheet is designated in the print job and the preprinted sheet is used not as the inserting sheet but as the print target, the determining unit determines to perform the print processing for the preprinted sheet if the setting unit has set to permit the print processing for the preprinted sheet, and determines not to perform the print processing for the preprinted sheet if the setting unit has set to unexceptionally inhibit the print processing for the preprinted sheet, and wherein in the case where the preprinted sheet is designated in the print job and the preprinted sheet is used as the inserting sheet, the processing unit uses the preprinted sheet as the inserting sheet.

2. The apparatus according to claim 1, wherein the determining unit determines, in a case where the preprinted sheet is designated in the print job as the inserting sheet, to use the preprinted sheet as the inserting sheet independently of the result of the setting by the setting unit.

3. A control method for a printing apparatus, the method comprising:

setting, based on a designation by a user, whether to permit or to unexceptionally inhibit print processing for a preprinted sheet which can be used as any of an inserting sheet and a print target;

accepting a print job;

determining, in a case where the preprinted sheet is designated in the print job and the preprinted sheet is used not as the inserting sheet but as the print target, whether or not to perform the print processing for the preprinted sheet, based on a result of setting in the setting step;

performing the print processing for the preprinted sheet in a case where it has been determined to perform the print processing for the preprinted sheet; and canceling the print job in a case where it has been determined not to perform the print processing for the preprinted sheet, wherein in the case where the preprinted sheet is designated in the print job and the preprinted sheet is used not as the inserting sheet but as the print target, in the determining step, it is determined to perform the print processing for the preprinted sheet if it has been set to permit the print processing for the preprinted sheet, and determined not to perform the print processing for the preprinted sheet if it has been set to unexceptionally inhibit the print processing for the preprinted sheet, and wherein in the case where the preprinted sheet is designated in the print job and the preprinted sheet is used as the inserting sheet, in the performing step, the preprinted sheet is used as the inserting sheet.

4. A non-transitory computer-readable storage medium storing a computer program for causing a computer to execute steps of a control method for a printing apparatus, the method comprising:

setting, based on a designation by a user, whether to permit or to unexceptionally inhibit print processing for a preprinted sheet which can be used as any of an inserting sheet and a print target;

accepting a print job;

determining, in a case where the preprinted sheet is designated in the print job and the preprinted sheet is used not as the inserting sheet but as the print target, whether or not to perform the print processing for the preprinted sheet, based on a result of setting in the setting step;

performing the print processing for the preprinted sheet in a case where it has been determined to perform the print processing for the preprinted sheet; and canceling the print job in a case where it has been determined not to perform the print processing for the preprinted sheet, wherein in the case where the preprinted sheet is designated in the print job and the preprinted sheet is used not as the inserting sheet but as the print target, in the determining step, it is determined to perform the print processing for the preprinted sheet if it has been set to permit the print processing for the preprinted sheet, and it is determined not to perform the print processing for the preprinted sheet if it has been set to unexceptionally inhibit the print processing for the preprinted sheet, and wherein in the case where the preprinted sheet is designated in the print job and the preprinted sheet is used as the inserting sheet, in the performing step, the preprinted sheet is used as the inserting sheet.

5. A printing apparatus comprising:

a setting unit configured to set, based on a designation by a user, whether to permit or to unexceptionally inhibit print processing for a preprinted sheet which can be used as any of an inserting sheet and a print target;

an accepting unit configured to accept a print job;

a determining unit configured to determine, in a case where the preprinted sheet is designated in the print job and the preprinted sheet is used not as the inserting sheet but as the print target, whether or not to perform the print processing for the preprinted sheet, based on a result of setting by the setting unit; and a processing unit configured to perform the print processing for the preprinted sheet in a case where the determining unit has determined to perform the print processing for the preprinted sheet, and to control;

whether to cancel the print job or to change a type of a sheet to be used for the print processing in accordance with a user's instruction in a case where the determining unit has determined not to perform the print processing for the preprinted sheet, wherein in the case where the preprinted sheet is designated in the print job and the preprinted sheet is used not as the inserting sheet but as the print target, the determining unit determines to perform the print processing for the preprinted sheet if the setting unit has set to permit the print processing for the preprinted sheet, and determines not to perform the print processing for the preprinted sheet if the setting unit has set to unexceptionally inhibit the print processing for the preprinted sheet, and wherein in the case where the preprinted sheet is designated in the print job and the preprinted sheet is used as the inserting sheet, the processing unit uses the preprinted sheet as the inserting sheet.

6. The apparatus according to claim 5, further comprising a displaying unit configured to display a designation screen for prompting a user to instruct whether to cancel the print job or to change a type of a sheet to be used for the print processing, in the case where the determining unit has determined not to perform the print processing for the preprinted sheet, wherein the processing unit cancels the print job in a case where the user has instructed to cancel the print job via the designation screen, and performs the print processing for a sheet of a type after being changed in a case where the user has instructed to change a type of a sheet to be used for the print processing via the designation screen.

7. The apparatus according to claim 5, wherein the determining unit determines, in a case where the preprinted sheet is designated in the print job as the inserting sheet, to use the preprinted sheet as the inserting sheet independently of the result of the setting by the setting unit.

8. A control method for a printing apparatus, the method comprising:

setting, based on a designation by a user, whether to permit or to unexceptionally inhibit print processing for a preprinted sheet which can be used as any of an inserting sheet and a print target;

accepting a print job;

determining, in a case where the preprinted sheet is designated in the print job and the preprinted sheet is used not as the inserting sheet but as the print target, whether or not to perform the print processing for the preprinted sheet, based on a result of setting in the setting step;

performing the print processing for the preprinted sheet in a case where it has been determined to perform the print processing for the preprinted sheet; and controlling whether to cancel the print job or to change a type of a sheet to be used for the print processing in accordance with a user's instruction in a case where it has been determined not to perform the print processing for the preprinted sheet, wherein in the case where the preprinted sheet is designated in the print job and the preprinted sheet is used not as the inserting sheet but as the print target, in the determining step, it is determined to perform the print processing for the preprinted sheet if it has been set to permit the print processing for the preprinted sheet, and it is determined not to perform the print processing for the preprinted sheet if it has been set to unexceptionally inhibit the print processing for the preprinted sheet, and wherein in the case where the preprinted sheet is designated in the print job and the preprinted sheet is used as the inserting sheet, in the performing step, the preprinted sheet is used as the inserting sheet.

9. A non-transitory computer-readable storage medium storing a computer program for causing a computer to execute steps of a control method for a printing apparatus, the method comprising:

setting, based on a designation by a user, whether to permit or to unexceptionally inhibit print processing for a preprinted sheet which can be used as any of an inserting sheet and a print target;

accepting a print job;

determining, in a case where the preprinted sheet is designated in the print job and the preprinted sheet is used not as the inserting sheet but as the print target, whether or not to perform the print processing for the preprinted sheet, based on a result of setting in the setting step;

performing the print processing for the preprinted sheet in a case where it has been determined to perform the print processing for the preprinted sheet; and controlling whether to cancel the print job or to change a type of a sheet to be used for the print processing in accordance with a user's instruction in a case where it has been determined not to perform the print processing for the preprinted sheet, wherein in the case where the preprinted sheet is designated in the print job and the preprinted sheet is used not as the inserting sheet but as the print target, in the determining step, it is determined to perform the print processing for the preprinted sheet if it has been set to permit the print processing for the preprinted sheet, and it is determined not to perform the print processing for the preprinted sheet if it has been set to unexceptionally inhibit the print processing for the preprinted sheet, and wherein in the case where the preprinted sheet is designated in the print job and the preprinted sheet is used as the inserting sheet, in the performing step, the preprinted sheet is used as the inserting sheet.

* * * * *